US010939758B2

(12) United States Patent
Kim

(10) Patent No.: US 10,939,758 B2
(45) **Date of Patent: *Mar. 9, 2021**

(54) REFRIGERATOR

(71) Applicant: LG ELECTRONICS INC., Seoul (KR)

(72) Inventor: Hyunbum Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/676,165

(22) Filed: Nov. 6, 2019

(65) Prior Publication Data

US 2020/0205567 A1 Jul. 2, 2020

(30) Foreign Application Priority Data

Dec. 28, 2018 (KR) ..... 10-2018-0172480

(51) Int. Cl.
*A47B 88/90* (2017.01)
*A47B 51/00* (2006.01)
(Continued)

(52) U.S. Cl.
CPC ..... *A47B 88/90* (2017.01); *A47B 51/00* (2013.01); *F25D 23/021* (2013.01); *F25D 25/025* (2013.01); *A47B 2088/901* (2017.01)

(58) Field of Classification Search
CPC A47B 2088/901; F25D 23/028; F25D 23/025
See application file for complete search history.

(56) References Cited

U.S. PATENT DOCUMENTS 5,115,822 A 5/1992 Nichols
9,377,238 B2 6/2016 Hall et al.
(Continued)

FOREIGN PATENT DOCUMENTS

CN 107062761 A 8/2017
CN 108759281 A 11/2018
(Continued)

OTHER PUBLICATIONS

Search Report of European Patent Office in Appl'n No. 19217619.6, dated May 15, 2020.
(Continued)

*Primary Examiner* — Daniel J Rohrhoff
(74) *Attorney, Agent, or Firm* — Dentons US LLP

(57) ABSTRACT

A refrigerator includes a cabinet having a storage space therein, and a drawer slidably movable forward and backward from the storage space. The drawer includes a door, a storage box provided at a rear surface of the door, an elevation plate disposed within the storage box, and an elevation device connected with one side of the elevation plate to vertically elevate the elevation plate. The elevation device includes a driving motor, a first curved rack to rotate by a rotational force generated by the driving motor, the first curved rack being curved at a predetermined curvature and having an outer circumferential surface, a first elevation bar to connect the first curved rack with the elevation plate, a second curved rack being curved at a predetermined curvature and having an outer circumferential surface to engage with the outer circumferential surface of the first curved rack, and a second elevation bar to connect the second curved rack with the elevation plate.

20 Claims, 20 Drawing Sheets

(51) Int. Cl.
*F25D 23/02* (2006.01)
*F25D 25/02* (2006.01)

(56) References Cited

U.S. PATENT DOCUMENTS

| | | | | |
|---|---|---|---|---|
| 10,465,970 | B1 * | 11/2019 | Kang | F25D 23/062 |
| 10,598,425 | B2 * | 3/2020 | Choi | F25D 25/022 |
| 2006/0021373 | A1 * | 2/2006 | Oh | F25D 25/025 62/407 |
| 2006/0022564 | A1 * | 2/2006 | Oh | F25D 25/025 312/404 |
| 2008/0018215 | A1 * | 1/2008 | Carden | F25D 25/025 312/404 |
| 2014/0265797 | A1 * | 9/2014 | Scheuring | A47B 51/00 312/404 |
| 2014/0265806 | A1 * | 9/2014 | Hall | F25D 25/025 312/408 |
| 2018/0128540 | A1 * | 5/2018 | Yasaka | B66F 7/28 |
| 2019/0293345 | A1 * | 9/2019 | Kim | F25D 25/025 |
| 2019/0390895 | A1 * | 12/2019 | Choi | B66F 7/0658 |
| 2020/0072533 | A1 * | 3/2020 | Cho | E05C 7/005 |
| 2020/0072540 | A1 * | 3/2020 | Kim | F25D 23/021 |
| 2020/0208906 | A1 * | 7/2020 | Kim | F25D 29/005 |

FOREIGN PATENT DOCUMENTS

| | | | |
|---|---|---|---|
| DE | 102017207220 | A1 | 10/2018 |
| EP | 3040664 | A2 | 7/2016 |
| FR | 2614514 | A1 | 11/1988 |
| JP | 05-296647 | A | 11/1993 |
| JP | 2018-200160 | A | 12/2018 |
| KR | 10-2006-0006321 | A | 1/2006 |
| KR | 10-0564412 | B1 | 3/2006 |
| KR | 10-2018-0101334 | A | 11/2018 |
| WO | 2010/099037 | A2 | 9/2010 |
| WO | 2013/098257 | A1 | 7/2013 |
| WO | 2018/088802 | A1 | 5/2018 |

OTHER PUBLICATIONS

Search Report of European Patent Office in Appl'n No. 19217526.3, dated May 29, 2020.
Search Report of European Patent Office in Appl'n No. 19217494.4, dated May 6, 2020.
Office Action of the U.S. Appl. No. 16/677,335, dated Apr. 16, 2020.
Office Action of the U.S. Appl. No. 16/678,016, dated Apr. 16, 2020.

* cited by examiner

REFRIGERATOR

CROSS-REFERENCE TO RELATED APPLICATIONS

The present application claims priority under 35 U.S.C. § 119 to Korean Application No. 10-2018-0172480 filed on Dec. 28, 2018, whose entire disclosures are hereby incorporated by reference.

BACKGROUND

The present disclosure relates to a refrigerator.

In general, refrigerators are home appliances for storing food at a low temperature in a storage space that is covered by a door. For this, the refrigerators cool the inside of the storage space by using cool air generated by being heat-exchanged with a refrigerant circulated through a refrigeration cycle to store food in an optimum state.

Such a refrigerator is becoming larger and multifunctioned as dietary changes and user's preferences become more diverse, and thus, a refrigerator having various structures and convenience devices for user's convenience and freshness of stored food has been introduced.

The storage space of the refrigerator may be opened/closed by the door. Also, refrigerators may be classified into various types according to an arranged configuration of the storage space and a structure of the door that opens and closes the storage space.

The refrigerator door may be classified into a rotation-type door that opens and closes a storage space through rotation thereof and a drawer-type door that is inserted and withdrawn in a drawer like manner.

Also, the drawer-type door is often disposed in a lower region of the refrigerator. Thus, when the drawer-type door is disposed in the lower region of the refrigerator, a user has to turn their back to take out a basket or food in the drawer-type door. If the basket or the food is heavy, the user may feel inconvenient to use the drawer-type door or may be injured.

In order to solve such a limitation, various structures are being developed in which the drawer-type door is capable of being elevated.

For example, a refrigerator provided with a lifting mechanism for elevating a storage box provided in a refrigerating compartment is disclosed in Korean Patent Publication No. 2006-0006321 (Jan. 19, 2006).

However, the lifting mechanism for the elevation is disposed outside the storage box, and thus is exposed. This may cause serious safety problems. In addition, the lifting mechanism may become contaminated due to the lifting mechanism being exposed to the outside.

Also, since a driving part of the lifting mechanism is exposed to the outside, noise during operation of the driving part may be transmitted to the outside as is, which may cause the user's dissatisfaction.

In addition, since a frame on which the storage box is seated has an L shape, an upper end of the frame may protrude further upward than an upper end of the door. As a result, an elevation height of the storage box may be limited.

If an upper end of a vertical portion of the frame protrudes further than a top surface of the door, the vertical portion of the frame may be exposed to the outside to aesthetically deteriorate an outer appearance. Furthermore, when the frame descends, the user's clothing or body parts may get caught to cause an accident.

SUMMARY

The present disclosure has been proposed to improve the above-described limitations.

Embodiments provide a refrigerator including an elevation plate disposed in a storage box and an elevation device configured to allow the elevation plate to move vertically.

The elevation device may include: a driving motor; a first curved rack configured to rotate by rotation force generated from the driving motor, the first curved rack being curved at a predetermined curvature; a first elevation bar configured to connect the first curved rack to the elevation plate; a second curved rack having an outer circumferential surface engaged with an outer circumferential surface of the first curved rack to rotate; and a second elevation bar configured to connect the second curved rack to the elevation plate.

The refrigerator may further include a driving gear and a driving motor to drive the second curved rack.

Each of the first and second curved racks may have a circular shape or an arc shape.

A plate support device may be connected to the elevation plate so that the elevation plate is elevated while being maintained in a horizontal state.

The details of one or more embodiments are set forth in the accompanying drawings and the description below. Other features will be apparent from the description and drawings, and from the claims.

DETAILED DESCRIPTION OF THE EMBODIMENTS

Hereinafter, an elevation device and a refrigerator including the same according to the embodiments will be described in detail with reference to the accompanying drawings.

Figure 1:
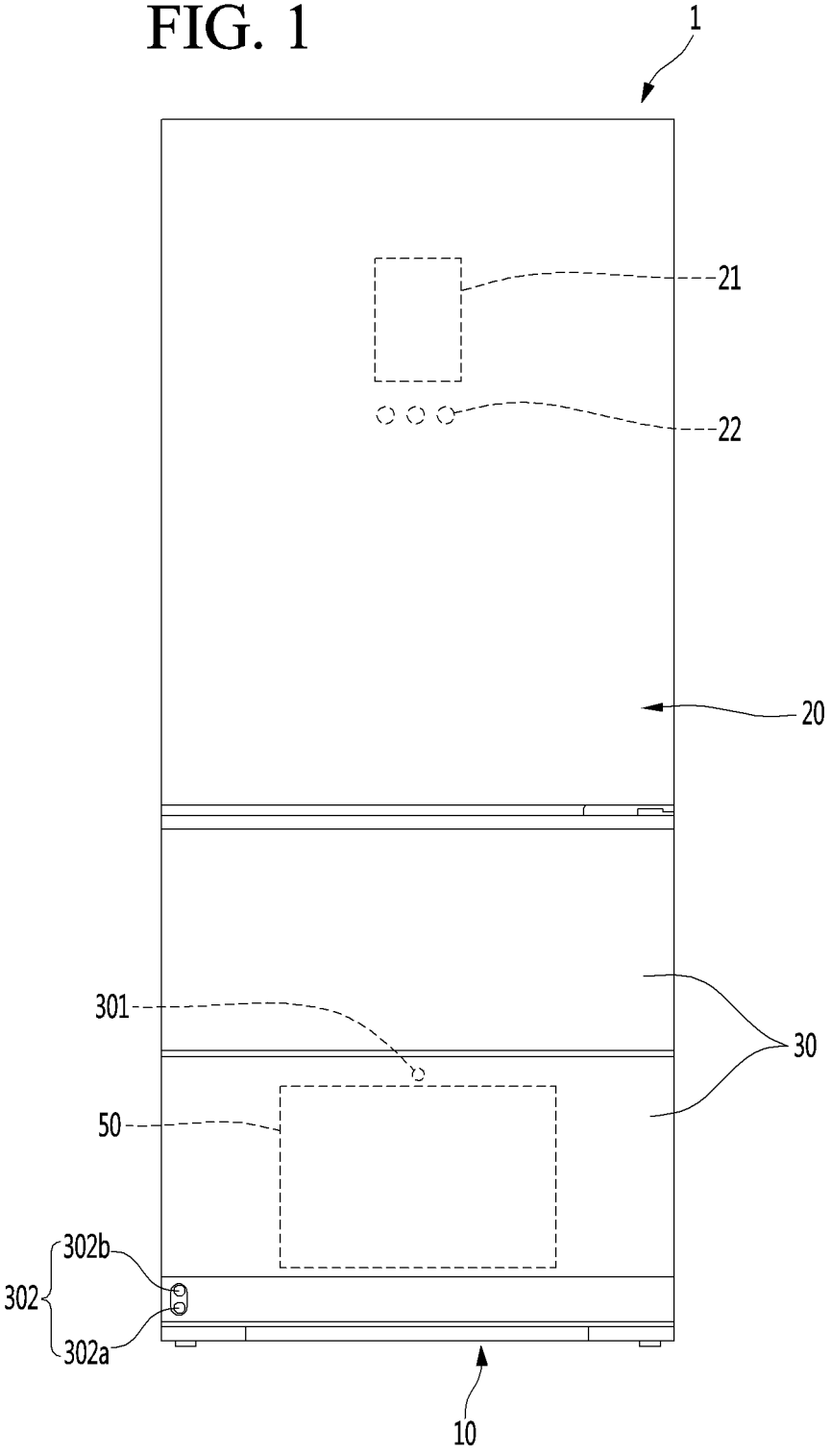
FIG. 1 is a front view of a refrigerator provided with an elevation device according to an embodiment.
Figure 2:
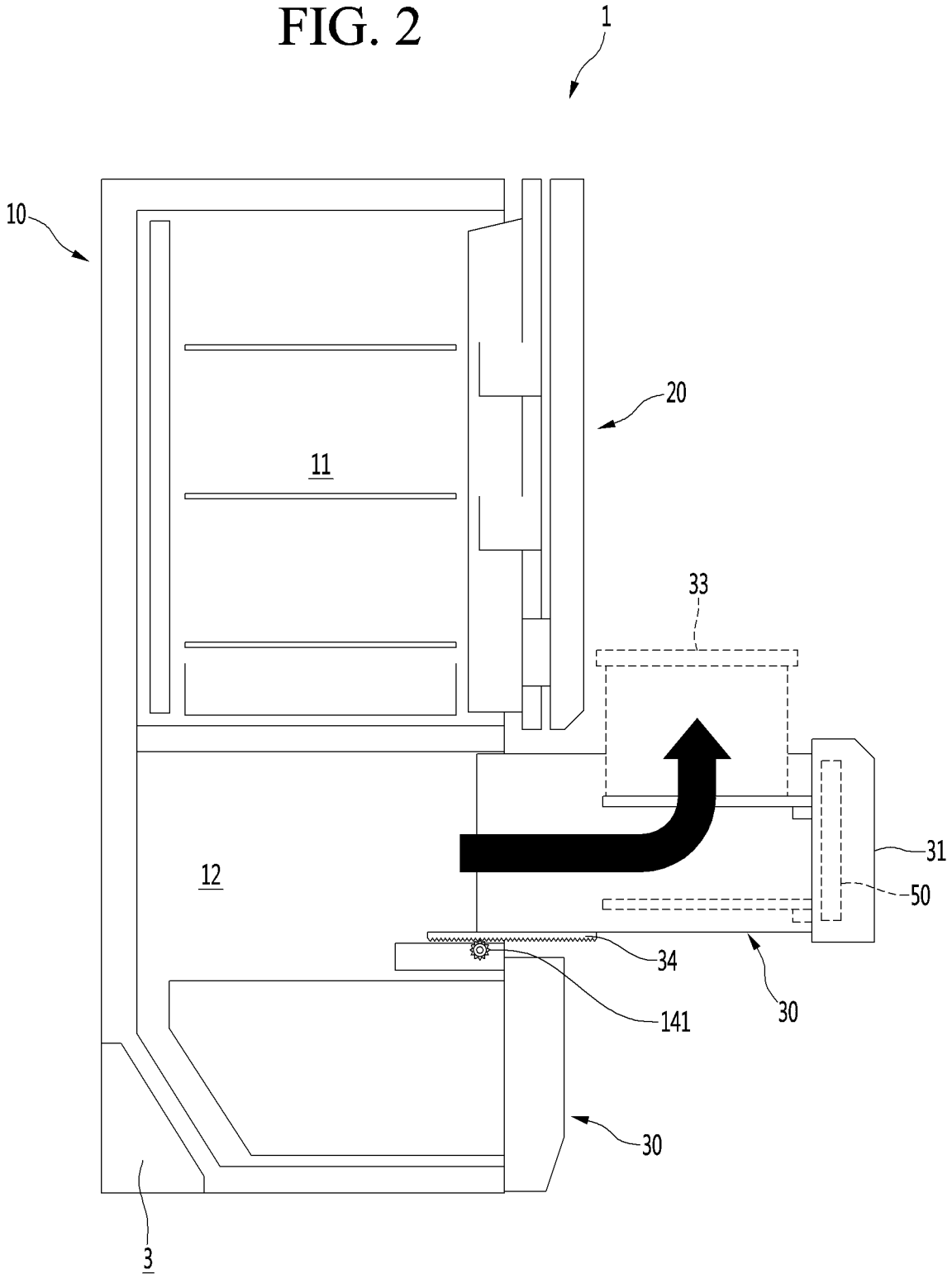
FIG. 2 is a side cross-sectional view of the refrigerator when a drawer provided with the elevation device ascends after being withdrawn.

FIG. 1 is a front view of a refrigerator provided with an elevation device according to an embodiment, and FIG. 2 is a side cross-sectional view of the refrigerator when a drawer provided with the elevation device ascends after being withdrawn.

Referring to FIGS. 1 and 2, a refrigerator 1 according to the embodiment includes a cabinet 10 defining a storage space and a door that covers an opened front surface of the cabinet 10.

The storage space of the cabinet 10 may be partitioned into a plurality of spaces. For example, the storage space may be partitioned into an upper storage space 11 and a lower storage space 12 by a partition member such as a mullion. Also, one of the upper storage space 11 and the lower storage space 12 may be a refrigerating compartment and the other may be a freezing compartment. The upper storage space 11 and the lower storage space 12 may be independent spaces that are maintained at different temperatures. Also, the embodiment does not exclude that the storage space may be partitioned into three or more spaces in which internal temperatures are maintained to be different from each other.

The door includes a rotatable door 20 rotatably coupled to the front surface of the cabinet 10 and a sliding door 31 coupled to a drawer that is slidably inserted into the upper storage space 11 or the lower storage space 12.

A plurality of drawers 30 may be accommodated in the lower storage space 12. Here, the plurality of drawers may be disposed vertically. Of course, the embodiment does not exclude that the drawer 30 is disposed in the upper storage space 11.

An elevation device 50 according to the embodiment is provided to elevate food stored in the drawer 30. Thus, the elevation device 50 may be provided in the sliding door 31 of the drawer 30.

A display 21 may be disposed on one side of a front surface of the rotating door 20. The display 21 may have a liquid crystal display structure or a 88 segment display structure.

Also, a manipulation part 22 to input an opening/closing command of the rotating door 20 and/or the drawer may be provided on one side of the front surface of the rotating door 20.

The manipulation part 22 may be integrated with the display 21 and may operate in a touch type manner or a button type manner. The manipulation part 22 may be used to input a command related to an operation of the refrigerator 1 such as setting a temperature within the storage space. Also, the manipulation part 22 may be used to input a draw-in/out command of the drawer 30 and/or an operation command of the elevation device.

A manipulation part 301 may be provided at the drawer 30. Particularly, the manipulation part 301 may be provided on a front surface of the sliding door 31 of the drawer 30. The manipulation part 301 may be used to input a draw-in/out command of the drawer 30 and/or an operation command of the elevation device. Here, the manipulation part 301 may be provided in a touch button type or a mechanical button type. The manipulation part 301 may be provided as a sensor detecting proximity or movement of the user or provided as an input unit that operates by a user's motion or voice.

Also, as illustrated in the drawings, a manipulation device 302 may be provided at a lower end of the lowermost drawer 30. The manipulation device 302 may include a sensor 302*a* detecting user's approach and an image projecting device 302*b* projecting an image to a bottom of an installation space in which the refrigerator 1 is installed. Thus, when the sensor 302*a* detects the user's approach, a specific image or an image may be projected onto the installation surface by the image projecting device 302*b*. Also, the user may access the image projected onto the bottom so that a specific command including the draw-in/out command of the drawer may be performed.

The drawer 30 may be designed to move horizontally forward and backward by a draw-out motor (not shown) and a pinion 141, which are provided at the cabinet 10, and a draw-out rack 34 or a rail, which is provided at a bottom surface of the drawer 30. Also, the operation command of the draw-out motor may be inputted through any one or all of the manipulation parts 22 and 301.

Also, the drawer 30 may be designed to continuously perform a horizontal sliding operation and a vertical elevating operation through a single draw-out command.

Figure 3:
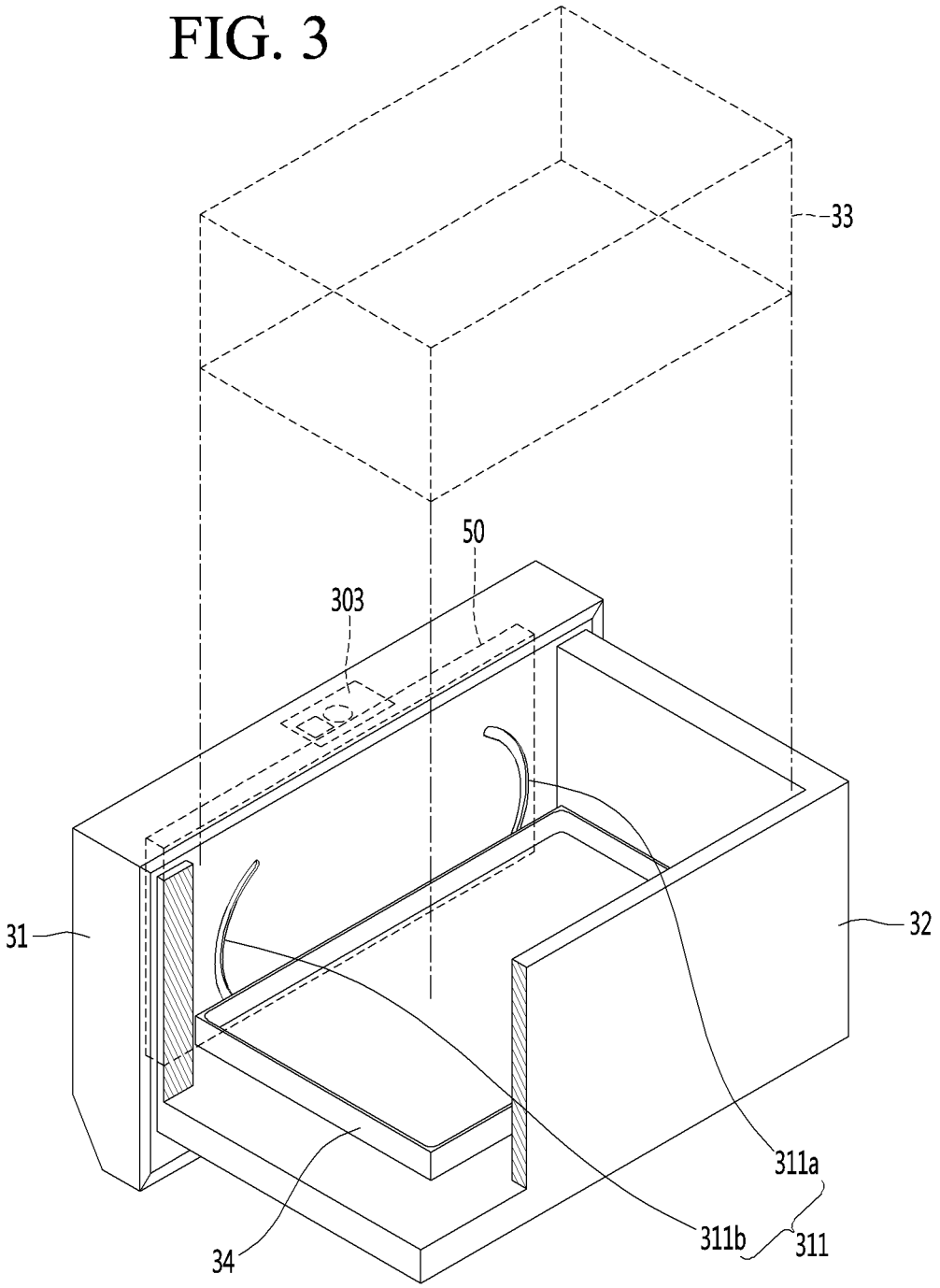
FIG. 3 is a rear perspective view of the drawer provided with the elevation device according to an embodiment.
Figure 4:
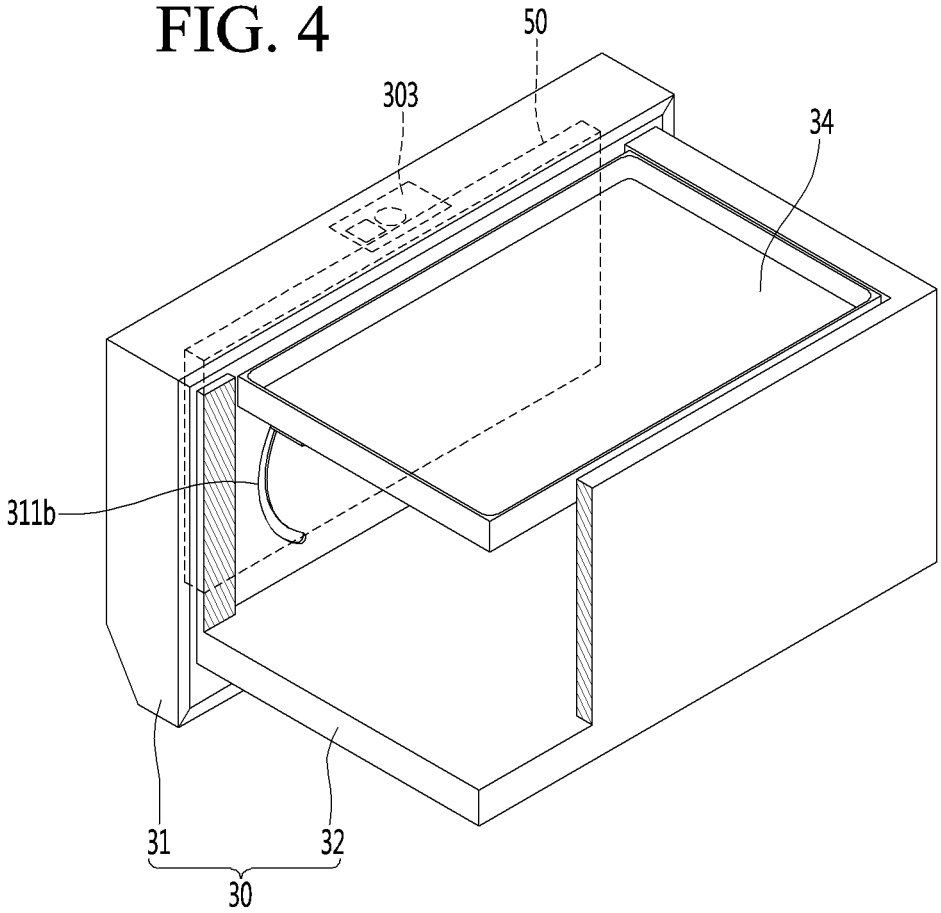
FIG. 4 is a rear perspective view of the drawer when an elevation plate ascends.

FIG. 3 is a rear perspective view of the drawer provided with the elevation device according to an embodiment, and FIG. 4 is a rear perspective view of the drawer when the elevation plate ascends.

Referring to FIGS. 3 and 4, the drawer 30 of the refrigerator according to the embodiment may include a sliding door 31, a storage box 32 disposed at a rear surface of the sliding door 31, and an elevation plate 34 disposed at the storage box 32. Also, the elevation device 50 according to an embodiment is disposed at the sliding door 31 and may be mechanically connected to the elevation plate 34 to allow the elevation plate 34 to move in the vertical direction.

The food may be directly placed on the elevation plate 34 so as to be stored. Alternatively, a separate storage case 33 may be provided at the storage box 32 so that the food is placed in the separate storage case 33, which is placed on the elevation plate 34.

A guide slit 311 having an arc shape may be disposed at the rear surface of the sliding door 31, and an elevation bar to be described later may be inserted into the guide slit 311. In other words, the elevation bar included in the elevation device 50 may pass through the rear surface of the sliding door 31 and may be connected to the elevation plate 34. The elevation bar may move vertically along the guide slit 311 to allow the elevation plate 34 to move vertically.

Here, the guide slit 311 may include a first guide slit 311*a* at one side of the rear surface of the sliding door 31 and a second guide slit 311*b* at the other side of the rear surface of the sliding door 31. The first guide slit 311*a* and the second guide slit 311*b* may be symmetrically disposed with respect to a vertical plane that bisects the sliding door 31 into a left portion and a right portion.

An elevation manipulation part 303 for inputting command to drive the elevation device 50 may be disposed at a top surface of the sliding door 31. The elevation manipulation part may include a touch type or button type input part and a display part. When the input part provided at the elevation manipulation part 303 is touched or pressed, the forward and backward movement and the elevation operation may be continuously performed, or only the elevation operation may be performed.

When the top surface of the sliding door 31 is inclined downward towards the front end, the elevation manipulation part 303 may be manipulated even when the drawer is closed. Thus, in a state in which the drawer 30 is closed, the input part of the elevation manipulation part 303 may be manipulated to sequentially perform the withdrawal of the drawer 30 and the ascending of the elevation plate 34.

Alternatively, a control program may be designed so that a drawer manipulation part 301 provided at the front surface of the sliding door 31 is manipulated to maximally withdraw the drawer 30 forward, and then, the elevation manipulation part 303 is manipulated to allow the elevation plate 34 to ascend.

Hereinafter, a structure and operation of the elevation device 50 according to an embodiment will be described in detail with reference to the accompanying drawings.

Figure 5:
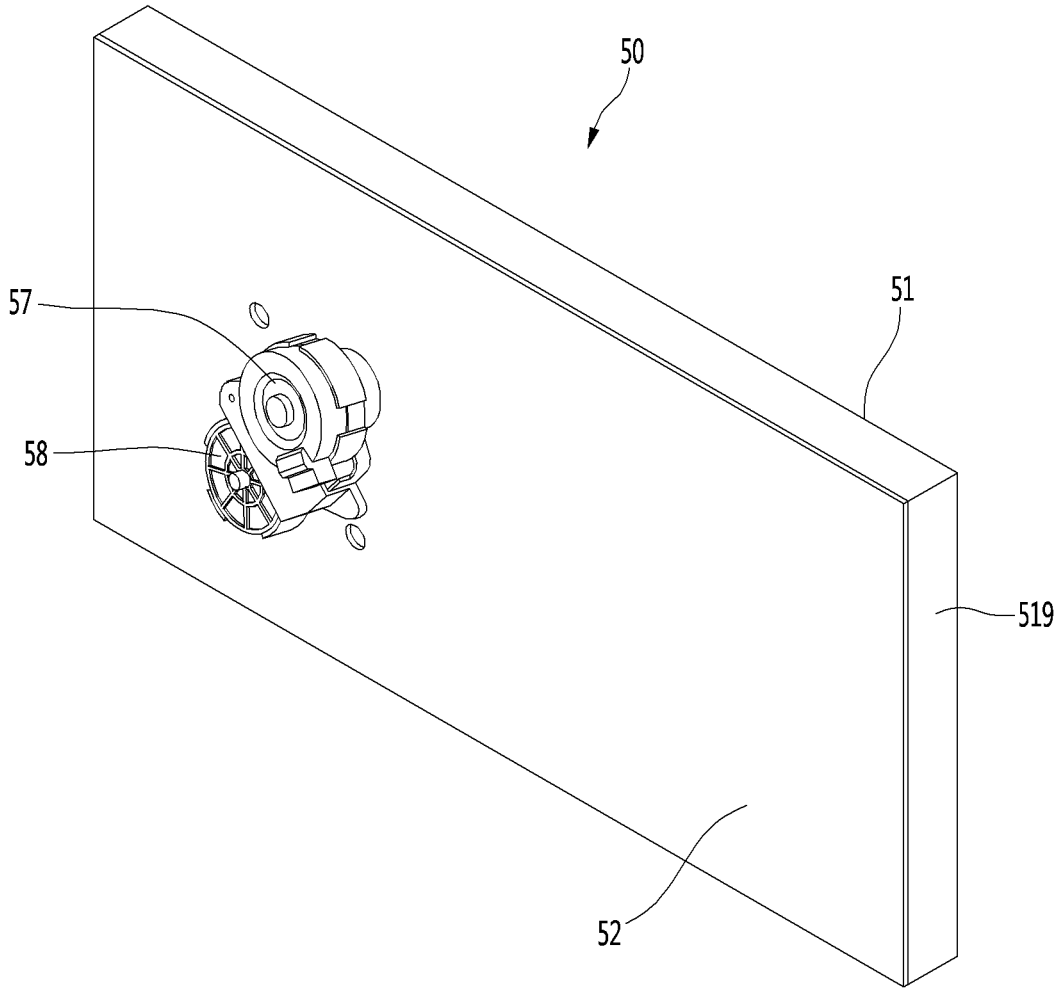
FIG. 5 is a front perspective view of the elevation device according to an embodiment.
Figure 6:
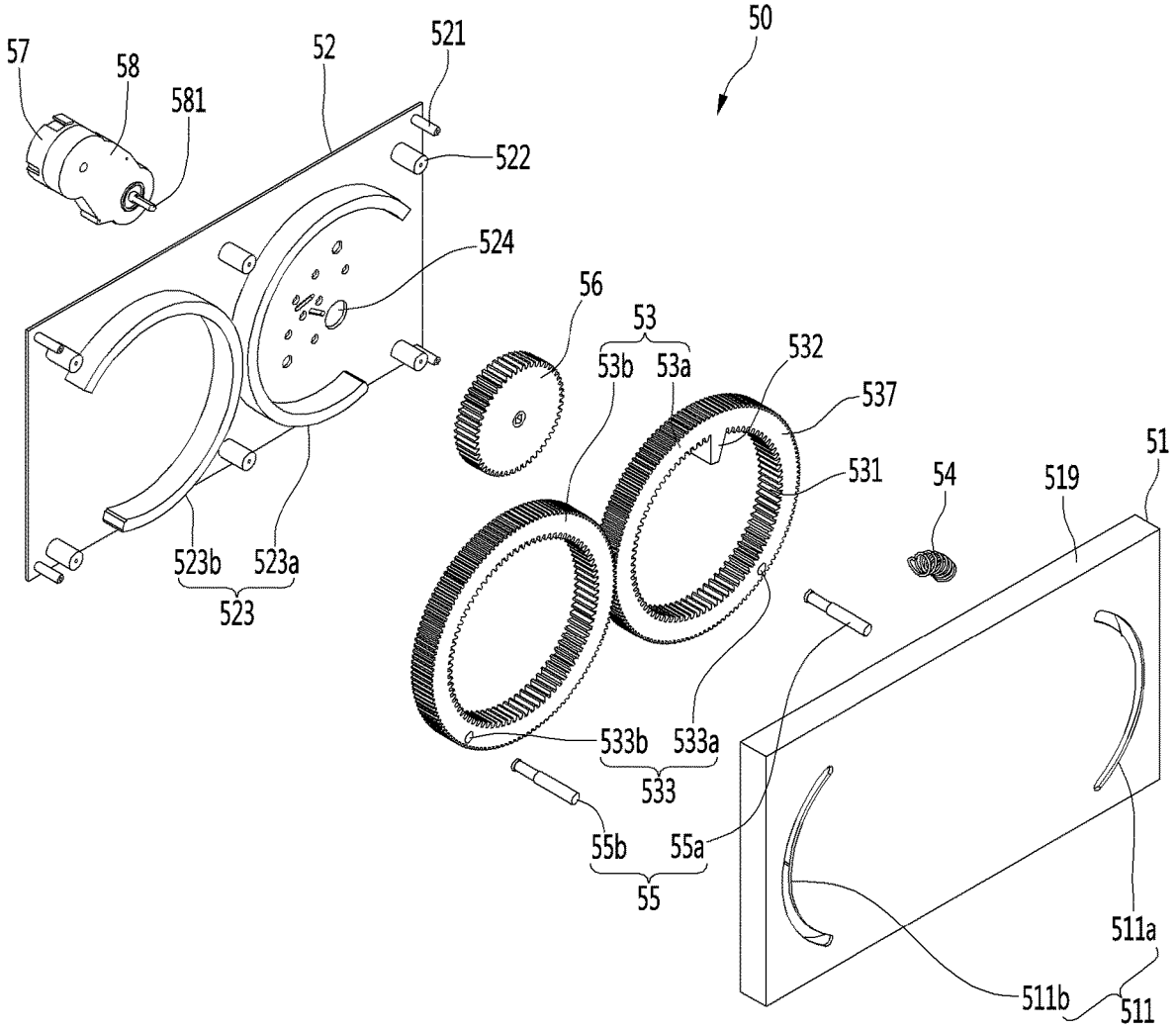
FIG. 6 is an exploded perspective view of the elevation device when viewed from a rear side.
Figure 7:
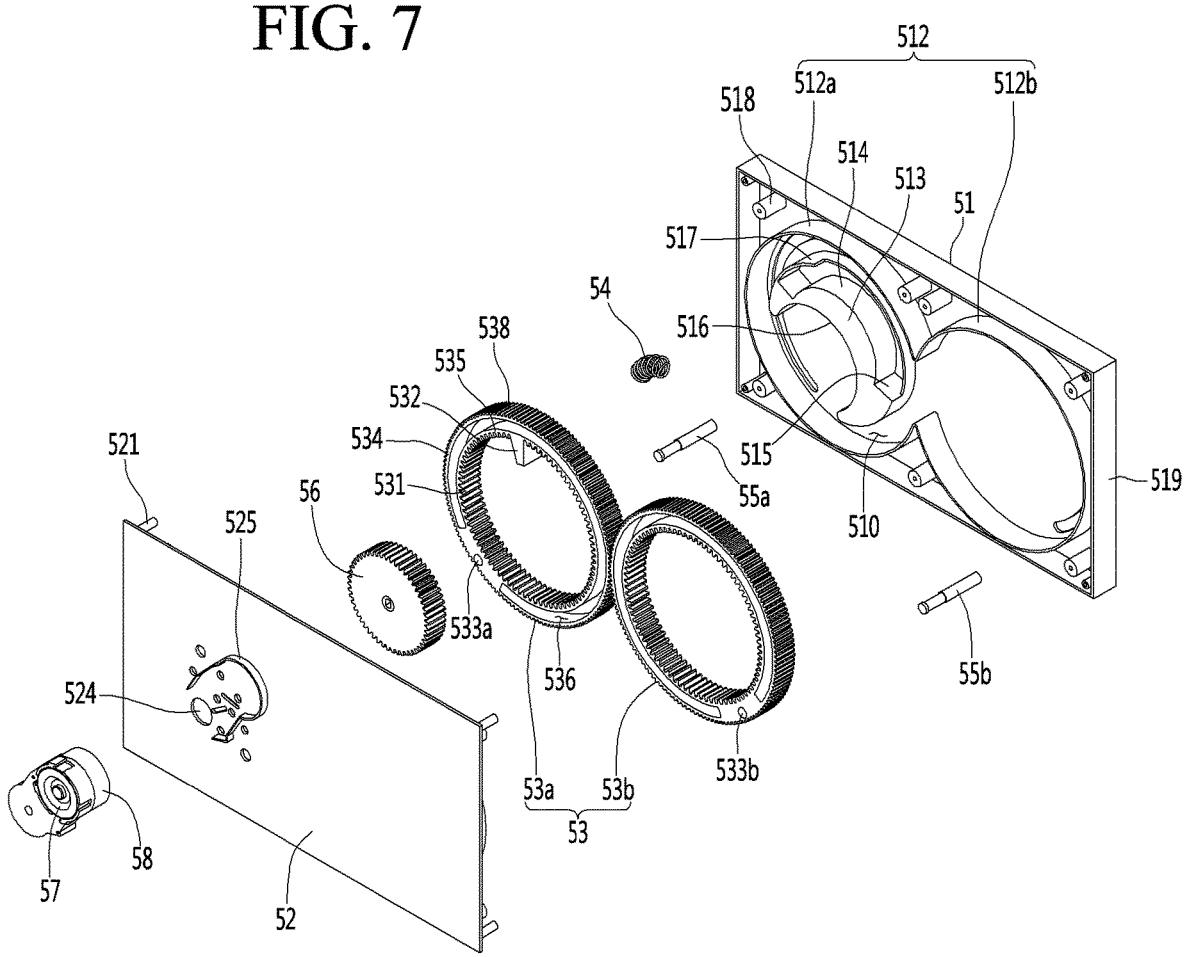
FIG. 7 is an exploded perspective view of the elevation device when viewed from a front side.

FIG. 5 is a front perspective view of the elevation device according to an embodiment, FIG. 6 is an exploded perspective view of the elevation device when viewed from a rear side, and FIG. 7 is an exploded perspective view of the elevation device when viewed from a front side.

Referring to FIGS. 5 to 7, the elevation device 50 according to the embodiment includes a housing 51, a spring 54, an elevation bar 55, a curved rack 53, a driving gear 56, a cover 52, a driving motor 57, and a reduction gear 58.

The curved rack 53 may include a first curved rack 53*a* gear-coupled to the driving gear 56 and a second curved rack 53*b* engaged with the first curved rack 53*a*.

The elevation bar 55 may also include a first elevation bar 55*a* connected to the first curved rack 53*a* and a second elevation bar 55*b* connected to the second curved rack 53*b*.

In detail, the sliding door 31 includes a front surface part exposed to the outside, a rear surface part as an opposite surface of the front surface part, and an edge part connecting the front surface part to the rear surface part. Also, the edge part includes a top surface, a bottom surface, a left surface, and a right surface.

The rear surface part of the sliding door 31 may include a first surface and a second surface. The first surface may be a surface which closely contacts the rear surface of the elevation device 50, and the second surface may be the front surface of the storage box 32.

A front surface of the housing 51 may be opened and covered by the cover 52, and a rear surface closely contacts the first surface of the rear surface part of the sliding door 31. Also, a side wall 519 extends at an edge of the housing 51, and the cover 52 is coupled to a front end of the side wall 519. The side wall 519 may be disposed on the housing 51, but may be disposed on an edge of the cover 52. An arc-shaped guide slit 511 may be at the rear surface of the housing 51. The guide slit 511 may be aligned with the guide slit 311 at the rear surface part of the sliding door 31. Thus, like the guide slit 311 of the sliding door 31, the guide slit 511 at the housing 51 may include a first guide slit 511*a* and a second guide slit 511*b*.

A support boss 518 and a coupling boss may protrude from a front corner point of the housing 51. The support boss 518 and the coupling boss may be disposed at four corners of the front surface of the housing 51, respectively.

An outer sleeve 512 surrounding an outer circumferential surface of the curved rack 53 may extend from the front surface of the housing 51. The outer sleeve 512 may extend by a length corresponding to an extension length (or width) of the side wall 519.

The outer sleeve 512 may be provided in a shape in which two circular sleeves overlap with each other to surround the outer circumferential surfaces of the pair of curved racks 53*a* and 53*b* disposed in a width direction of the housing 51. Also, an inner space of the outer sleeve 512 may be defined as a first space in which the first curved rack 53*a* is accommodated and a second space in which the second curved rack 53*b* is accommodated. Also, the first space and the second space may communicate with each other at a point at which the first curved rack 53*a* and the second curved rack 53*b* are engaged with each other. Thus, the outer sleeve 512 may have a 8 shape or a peanut shell shape.

A center mount 513 protrudes from the front surface of the housing 51 corresponding to the inside of the outer sleeve 512. A distance between an outer edge of the center mount 513 and the outer sleeve 512 may correspond to a radial width of the curved rack 53. Also, a space between the center mount 513 and the outer sleeve 512 may be defined as a curved rack mounting part 510 on which the curved rack 53 is mounted. Also, the guide slit 511 may be defined in the curved rack mounting part 510.

A spring seating part 514 may be at an edge of the center mount 513 at a predetermined depth in a central direction of the center mount 513 and may extend by a predetermined length in a circumferential direction. The spring seating part 514 may be rounded at a predetermined curvature. One end of the spring seating part 514 may include a shoulder 515, and a rack stopper 517 may extend from the other end of the spring seating part 514 in the circumferential direction of the center mount 513.

Also, a driving gear accommodation part 516 may be provided at an edge of the center mount 513, which corresponds to an opposite side of the spring seating part 514. The driving gear accommodation part 516 may be provided by cutting a portion of the center mount 513 in the central direction. The driving gear accommodation part 516 may be rounded at the same curvature as the driving gear 516 to accommodate a portion of a circumferential surface of the driving gear 56.

The spring 54 may be accommodated in the spring seating part 514. As illustrated in the drawings, the spring 54 may be a coil spring.

The left portion and the right portion of the housing 51 may be symmetrical to each other with respect to a vertical surface that bisects the housing into the left portion and the right portion. This may also be equally applicable to the cover 52.

For example, the center mount 513 including the spring seating part 514, the driving gear accommodation part 516, the rack stopper 517, and the shoulder 515 may be defined in the first space of the outer sleeve 513, but may also be defined in the second space. When the center mount 513 is provided in the second space, the center mount 513 may have a shape that is symmetrical to that of the center mount 513 provided in the first space. Also, in a structure in which one driving gear 56 is connected to only the first curved rack 53*a*, the driving gear accommodation part 516 may not be provided in the center mount provided in the second space. Also, two springs 54 may also be provided at positions symmetrical to each other.

The curved rack 53 may have a circular ring shape being hollow therein. In detail, the curved rack 53 includes an outer rim 534 having a width corresponding to a width of the outer sleeve 512, an inner rim 535 surrounded inside the outer rim 534 and having the same width as the outer rim 534, and a connection rim 537 connecting a rear end of the outer rim 534 to a rear end of the inner rim 535. Also, a guide groove 536 may be disposed between the outer rim 534 and the inner rim 535.

A gear part 531 may be disposed on an inner circumferential surface of the inner rim 535, and a spring pressing rib 532 may protrude from one side of the inner circumferential surface of the inner rim 535. The spring pressing rib 532 may have a width corresponding to the width of the inner rim 535 and extend by a predetermined length in the central direction of the curved rack 53.

Also, a gear part 538 may be disposed on an outer circumferential surface of the outer rim 534, and thus, the first curved rack 53*a* and the second curved rack 53*b* are gear-coupled to each other on the outer circumferential surface.

An elevation bar mounting part 533 may be provided in the form of a hole or groove at one side of the connection rim 537, and one end of the elevation bar 55 is fitted into the elevation bar mounting part 533. The elevation bar 55 may sequentially pass through the guide slits 511 and 311 and may be connected to the elevation plate 34. Each of the guide slits 511 and 311 may have a width corresponding to an outer diameter of the elevation bar 55.

One surface of the spring pressing rib 532 may press against one end of the spring 54. When the spring 54 extends maximally, the spring 54 may closely contact the shoulder 515. That is, when the curved rack 53 rotates, the spring pressing rib 532 moves in the circumferential direction within the spring seating part 514.

When the spring is also mounted on the second curved rack 53*b*, the spring pressing rib 532 is also disposed on the inner circumferential surface of the second curved rack 53*b*. The spring pressing rib 532 of the first curved rack 53*a* and the spring pressing rib of the second curved rack 53*b* relatively rotate at positions that are symmetrical to each other.

The elevation bar mounting part 533 includes a first elevation bar mounting part 533*a* provided at the first curved rack 53*a* and a second elevation bar mounting part 533*b* provided at the second curved rack 53*b*. The first elevation bar 55*a* may be inserted into the first elevation bar mounting part 533*a*, and the second elevation bar 55*b* may be inserted into the second elevation bar mounting part 533*b*.

The driving gear 56 may be accommodated in the driving gear accommodation part 516 and may be engaged with the gear part 531 of the inner circumferential surface to rotate the curved rack 53. Otherwise, the driving gear 56 may be engaged with the gear part 538 of the outer circumferential surface. According to this embodiment, a case in which the driving gear 56 rotates only the first curved rack 53*a* will be described as an example.

The reduction gear 58 may be seated on a front surface of the cover 52. A reduction gear support rib 525 extending along an outer edge of the reduction gear 58 may be disposed on the front surface of the cover 52.

A driving shaft hole 524 may be disposed at the cover 52 corresponding to the inside of the reduction gear support rib 525, and a driving shaft 581 extending from the reduction gear 58 passes through the driving shaft hole 524 and may be connected to a center of the driving gear 56.

An arc-shaped rack guide 523 extends from the rear surface of the cover 52, and the rack guide 523 may be fitted into the guide groove 536 of the curved rack 53. Both ends of the rack guide 523 extend up to both ends of the guide slit 511, respectively. However, the present disclosure is not limited thereto, and the rack guide 523 may have a circular sleeve shape.

In detail, the rack guide 523 may include a first rack guide 523*a* guiding the rotation of the first curved rack 53*a* and a second rack guide 523*b* guiding the rotation of the second curved rack 53*b*.

The coupling boss 521 and the support boss 522 may extend from the corner portion of the rear surface of the cover 52. Here, the coupling boss 521 and the support boss 522 may be coupled to the coupling boss and the support boss 518, which extend from the front surface of the housing 51. For example, the support boss 522 may be fitted into an outer circumferential surface of the support boss 518 of the housing 51 to allow the cover 52 to be coupled to the housing 51 without being shaken. Also, in a state in which the coupling boss 521 closely contacts the front surface of the housing 51, the coupling boss 521 may be coupled to the coupling boss through a coupling member.

The driving motor 57 and the reduction gear 58 may be modular coupled by a coupling bracket.

Figure 8:
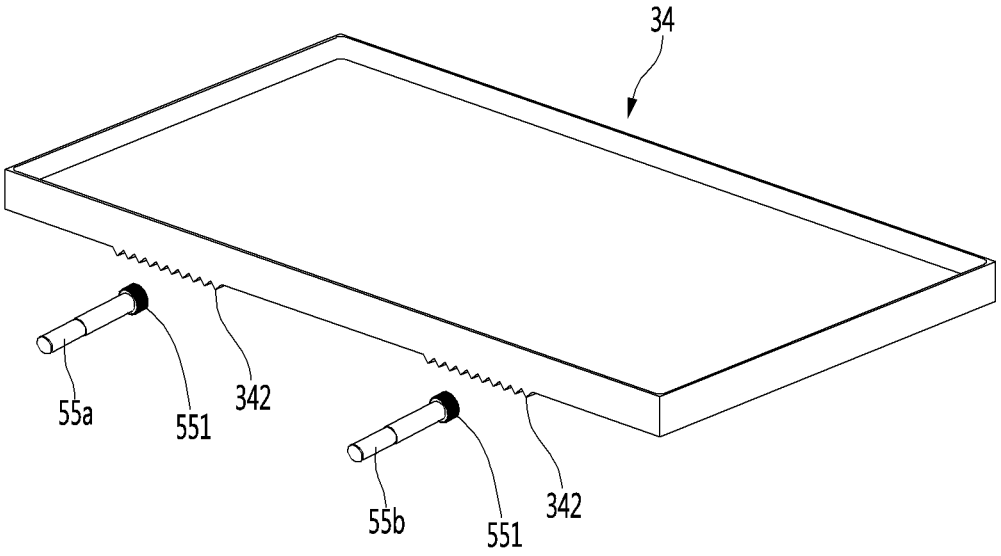
FIG. 8 is a view illustrating a connection structure between the elevation plate and an elevation bar according to an embodiment.

FIG. 8 is a view illustrating a connection structure between the elevation plate and the elevation bar according to an embodiment.

Referring to FIG. 8, a guide gear 342 may be disposed on the bottom surface of the elevation plate 34, and an idle gear 551 may be mounted at the other end of the elevation bar 55.

In detail, one end of the elevation bar 55 is connected to the curved rack 53, and the idle gear 551 is engaged with the guide gear 342.

In this state, when the curved rack 53 rotates, the elevation bar 55 moves in the circumferential direction of the curved rack 53 with a horizontal vector component and a vertical vector component. As a result, the idle gear 551 rotates from one end to the other end of the guide gear 342, and the elevation plate 34 moves vertically.

In this embodiment, since the two elevation bars 55*a* and 55*b* support the left bottom surface and the right bottom surface of the elevation plate 34, respectively, the two guide gears 342 may be also provided at the elevation plate 34 at the portions that contact the two elevation bars 55*a* and 55*b*, respectively. Also, the guide gear 342 extending in the width direction of the elevation plate 34 may have a length equal to or greater than a maximum moving distance in the horizontal direction of the elevation bar 55.

Figure 9:
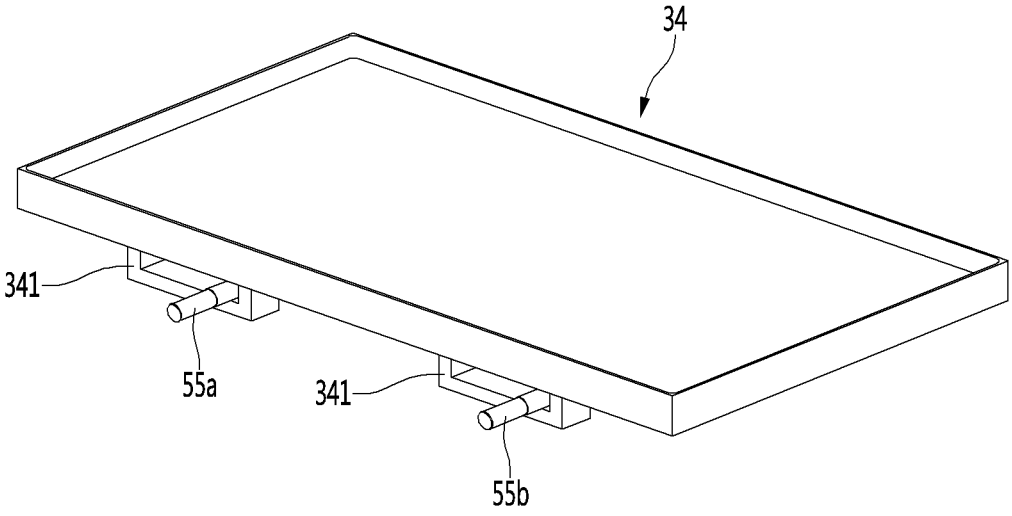
FIG. 9 is a view illustrating a connection structure between an elevation plate and an elevation bar according to another embodiment.

FIG. 9 is a view illustrating a connection structure between an elevation plate and an elevation bar according to another embodiment.

Referring to FIG. 9, an elevation bar having a U shape with a wide width may be disposed at a bottom surface of the front end of the elevation plate 34.

In detail, an elevation bar 55 is inserted into a space defined by an elevation bar guide 341. Thus, the elevation bar 55 moves in left and right directions within the elevation bar guide 341 to allow an elevation plate to move vertically.

An outer circumferential surface of the elevation bar 55 slidably moves in a state of contacting a bottom surface of the elevation plate 34.

As illustrated in FIG. 8, an idle gear may be connected to the other end of the elevation bar 55, and a guide gear may be disposed at the bottom surface of the elevation plate 34 corresponding to the inside of the elevation bar guide 341.

In this embodiment, since the two elevation bars 55 support the elevation plate 34, the elevation bar guides 341 are disposed on left and light bottom surfaces of a front end of the elevation plate 34, respectively.

Figure 10:
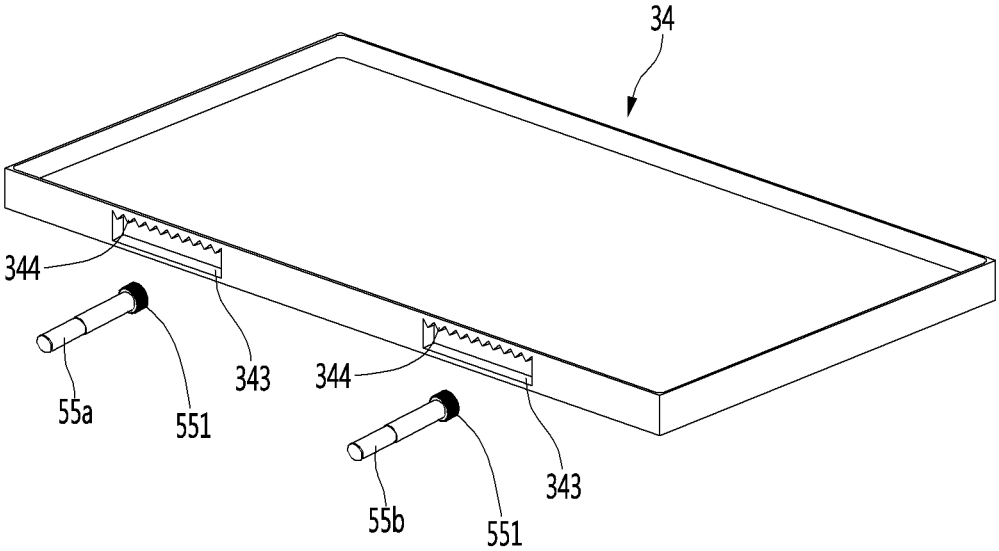
FIG. 10 is a view illustrating a connection structure between an elevation plate and an elevation bar according to another embodiment.

FIG. 10 is a view illustrating a connection structure between an elevation plate and an elevation bar according to another embodiment.

Referring to FIG. 10, a guide groove 343 may be disposed at a front surface of an elevation plate 34, and the other end of an elevation bar 55 is fitted into the guide groove 343. Thus, the elevation plate 34 and the elevation bar 55 may be connected to each other.

In detail, left and right lengths of the guide grooves 343 may correspond to a movement displacement in left and right directions of the elevation bar 55.

An idle gear 551 is disposed at the other end of the elevation bar 55. The idle gear 551 may be inserted into the guide groove 343. Of course, the guide gear 344 may be disposed at a top surface of the guide groove 343 so as to engaged with the idle gear 551.

The guide groove 343 may be disposed at each of front left and right sides of the elevation plate 34, respectively. Thus, the first elevation bar 55*a* and the second elevation bar 55*b* are inserted into the guide grooves 343.

Figure 11:
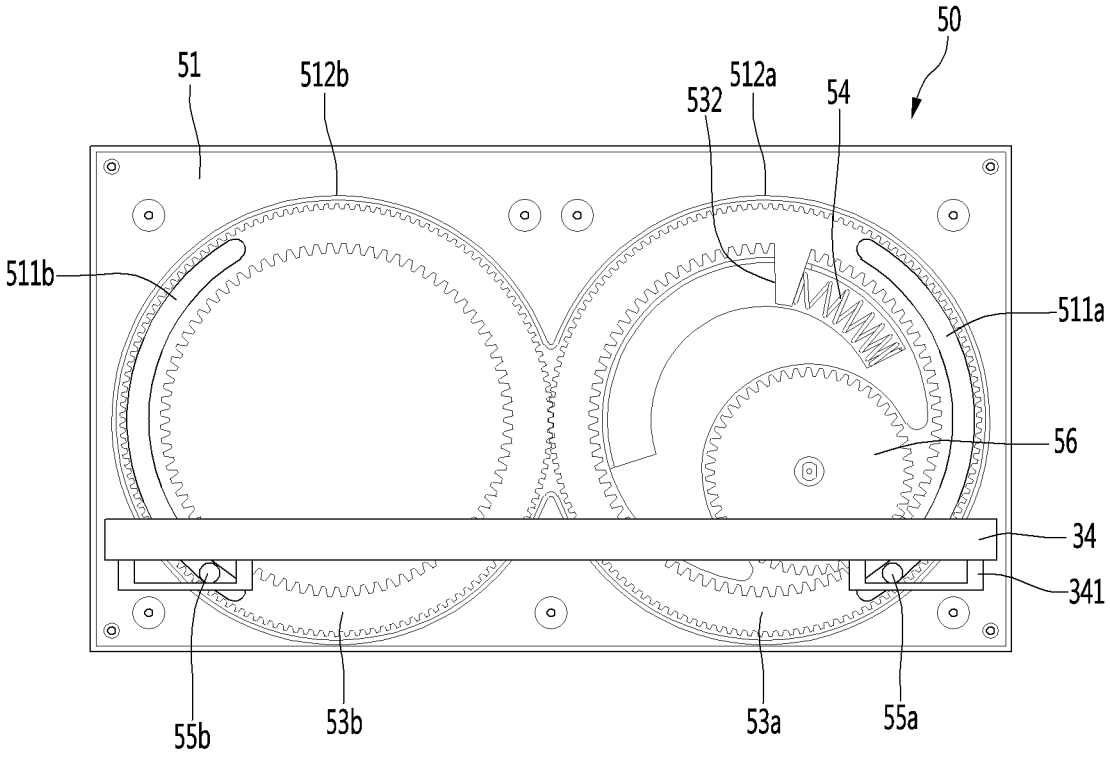
FIG. 11 is a rear view of the elevation device when the elevation plate is disposed at the lowest height in a state in which the drawer is removed.
Figure 12:
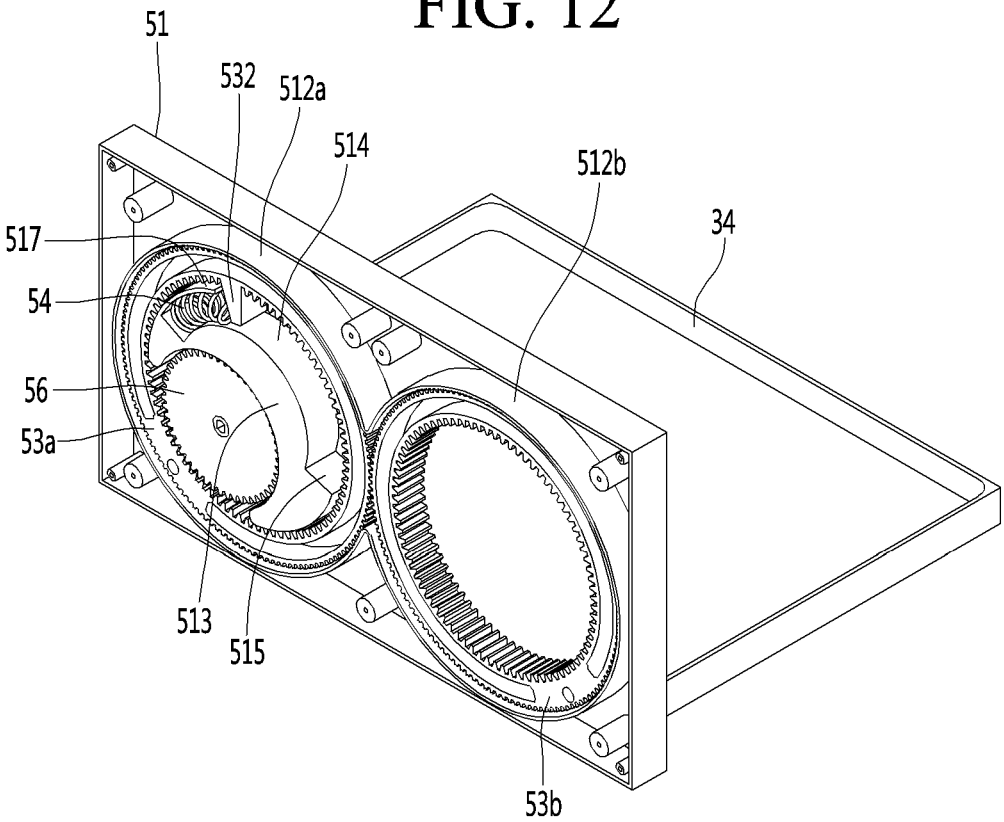
FIG. 12 is a view illustrating a state of the inside of the elevation device when the elevation plate is disposed at the lowest height.

FIG. 11 is a rear view of the elevation device when the elevation plate is disposed at the lowest height in a state in which the drawer is removed, and FIG. 12 is a view illustrating a state of the inside of the elevation device when the elevation plate is disposed at the lowest height.

Hereinafter, it is to be understood that the second curved rack 53*b* and the first curved rack 53*a* are driven in the same manner and also driven in directions symmetrical to each other with respect to a vertical plane even if not explicitly described because the pair of curved rack structures are arranged symmetrically with respect to the vertical plane.

Referring to FIG. 11, a state in which the elevation bar 55 is hung on the lowermost end of the guide slit 511 at the housing 51 may be a state in which the elevation plate 34 is disposed at the lowest height. Here, the elevation plate 34 may be disposed at a position that is closest to the bottom of the storage box 32.

The lowermost end of the guide slit 511 may extend up to a bottom center a2 corresponding to the lowermost end of the curved rack 53, and the uppermost end of the guide slit 511 may extend up to a top center a1 corresponding to the uppermost end of the curved rack 53.

In this embodiment, the first elevation bar 55*a* and the second elevation bar 55*b* may respectively ascend or descend along the first guide slit 511*a* and the second guide slit 511*b* to allow the elevation plate 34 to ascend or descend.

In a state in which the elevation plate 34 is disposed at the lowest point, the spring 54 may be in a state compressed by a minimum length. In detail, when the curved rack 53 rotates in a direction in which the elevation plate descends, the spring pressing rib 532 rotates in a direction of compressing the spring 54 within the spring seating part 514.

Since restoring force of the spring 54 may prevent the elevation plate 34 from descending sharply, it is preferable that the spring 54 is compressed when the elevation plate 34 descends.

Also, when the elevation plate 34 is disposed at the lowest point, the spring pressing rib 532 may contact the rack stopper 517 so that the curved rack 53 does not rotate further.

The driving of the curved rack 53 has been described so far as being limited to the driving of the first curved rack 53*a*. It is noted that further explanation is omitted because the driving of the second curved rack 53*b* is also the same as the driving of the first curved rack 53*a*, and also, the driving of the second curved rack 53*b* is performed symmetrical to the driving of the first curved rack 53*a*. And, it is noted that this description applies equally to the case in which the elevation plate ascends to an initial height.

Figure 13:
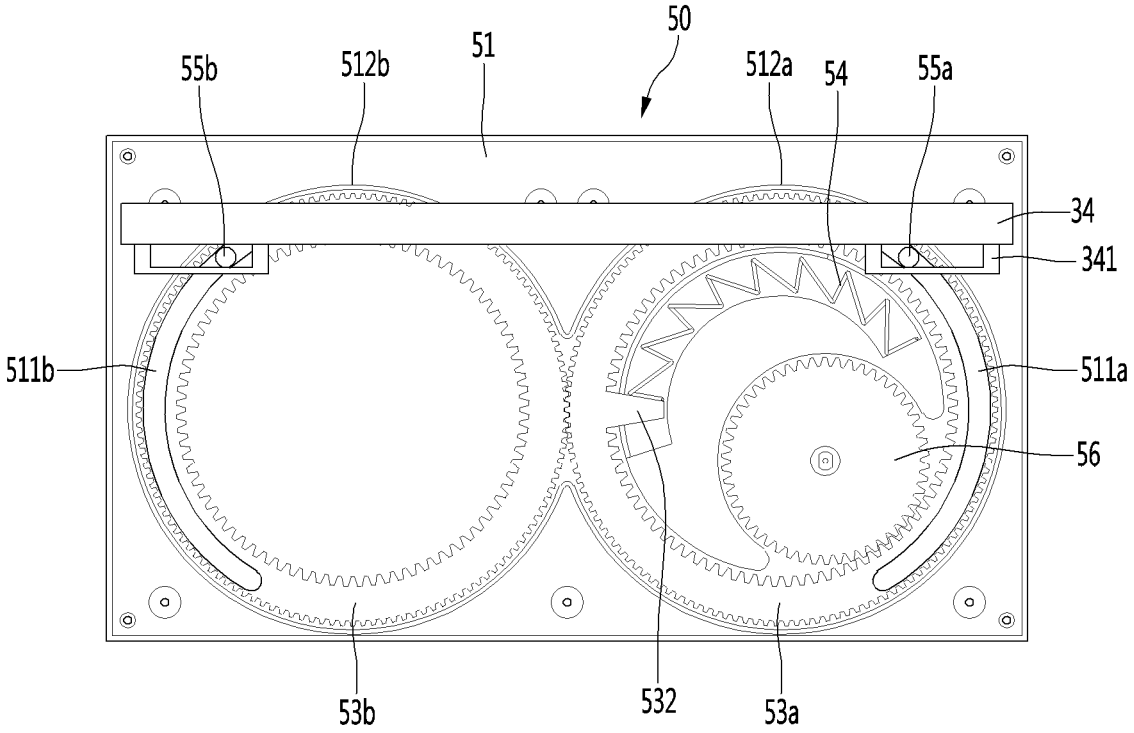
FIG. 13 is a rear view of the elevation device when the elevation plate is disposed at the highest height in the state in which the drawer is removed.
Figure 14:
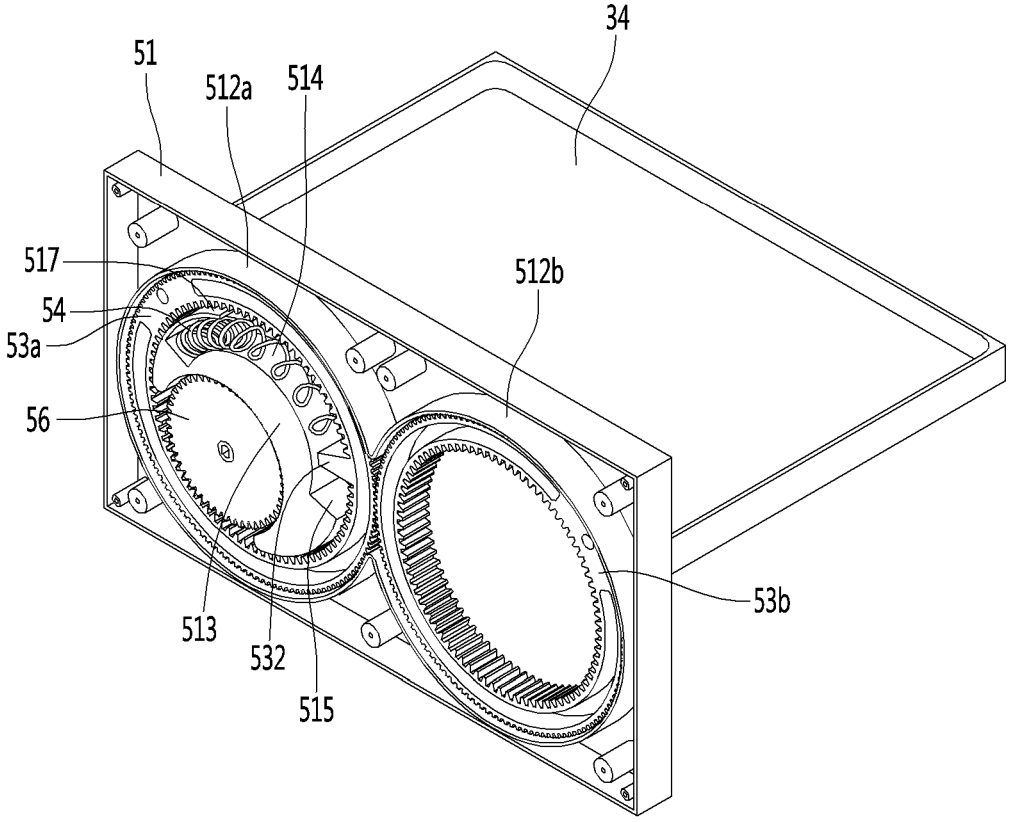
FIG. 14 is a view illustrating a state of the inside of the elevation device when the elevation plate is disposed at the highest height.

FIG. 13 is a rear view of the elevation device when the elevation plate is disposed at the highest height in the state in which the drawer is removed, and FIG. 14 is a view illustrating a state of the inside of the elevation device when the elevation plate is disposed at the highest height.

Referring to FIGS. 13 and 14, when the driving gear 56 rotates in the opposite direction, the curved rack 53 also rotates in the opposite direction, and the spring pressing rib 532 rotates in a direction of restoring the spring 54 to its original state. Also, the elevation bar 55 pushes up the elevation plate 34 while rotating along the guide slit 511.

That is, as the curved rack 53 rotates, and thus, the elevation plate 34 ascends, the spring 54 extends in the direction of restoring to its original state. In addition, the restoring force of the spring 54 acts as force of pushing up the elevation plate 34 to reduce a load of the driving motor 57.

When the elevation plate 34 reaches the highest point, the spring pressing rib 532 may contact the shoulder 515 corresponding to the end of the spring seating part 514. When the spring pressing rib 532 contacts the shoulder 515, the curved rack 53 does not rotate further.

Hereinafter, a plate support device for stably supporting the elevation plate 34 will be described as an example.

If the elevation device 50 is provided only at one edge of the elevation plate 34, when the elevation plate ascends or descends, an edge of the other side of the elevation plate 34, i.e., an edge of an opposite side of the edge to which the elevation device is connected may droop.

As a result, when the elevation plate 34 ascends, a horizontal state may not be maintained. Thus, the edge of the elevation plate 34 may interfere with the inner circumferential surface of the storage box 32 to cause noise, and the driving motor may be burdened with increase in load.

Therefore, there may be a need for a support device for preventing the elevation plate from drooping during the elevation operation of the elevation plate 34.

Figure 15:
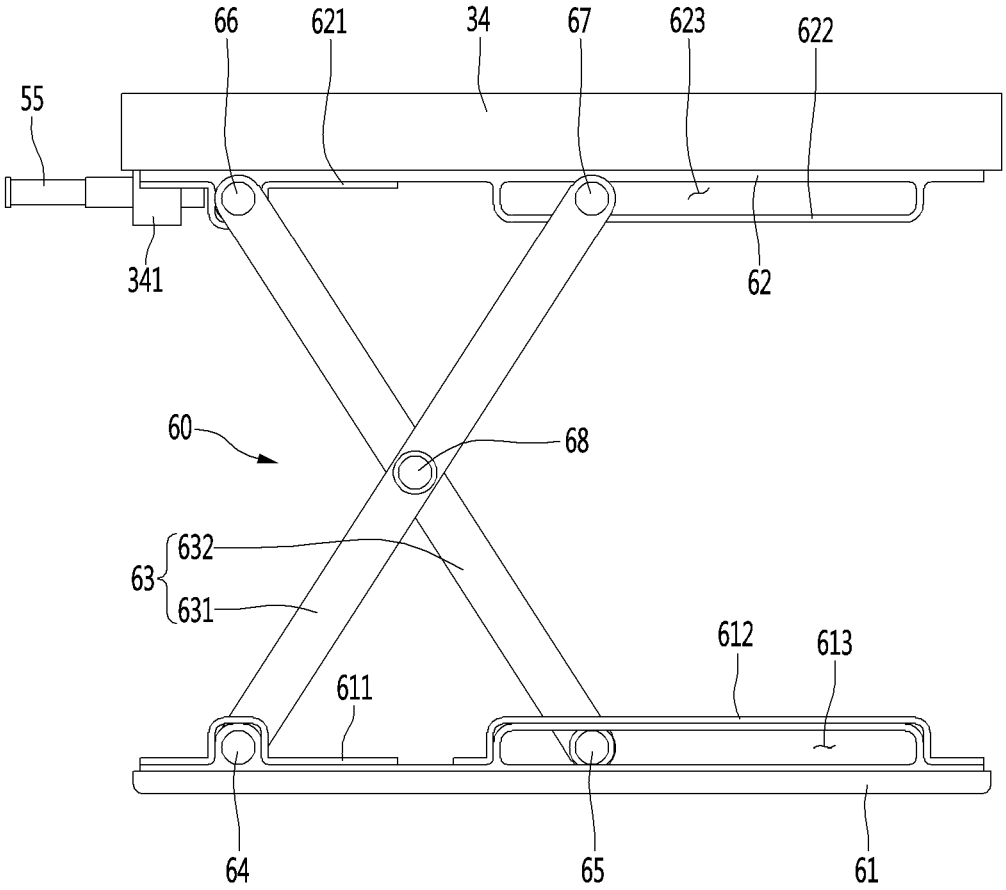
FIG. 15 is a side view of the elevation plate to which a plate support device is coupled.
Figure 16:
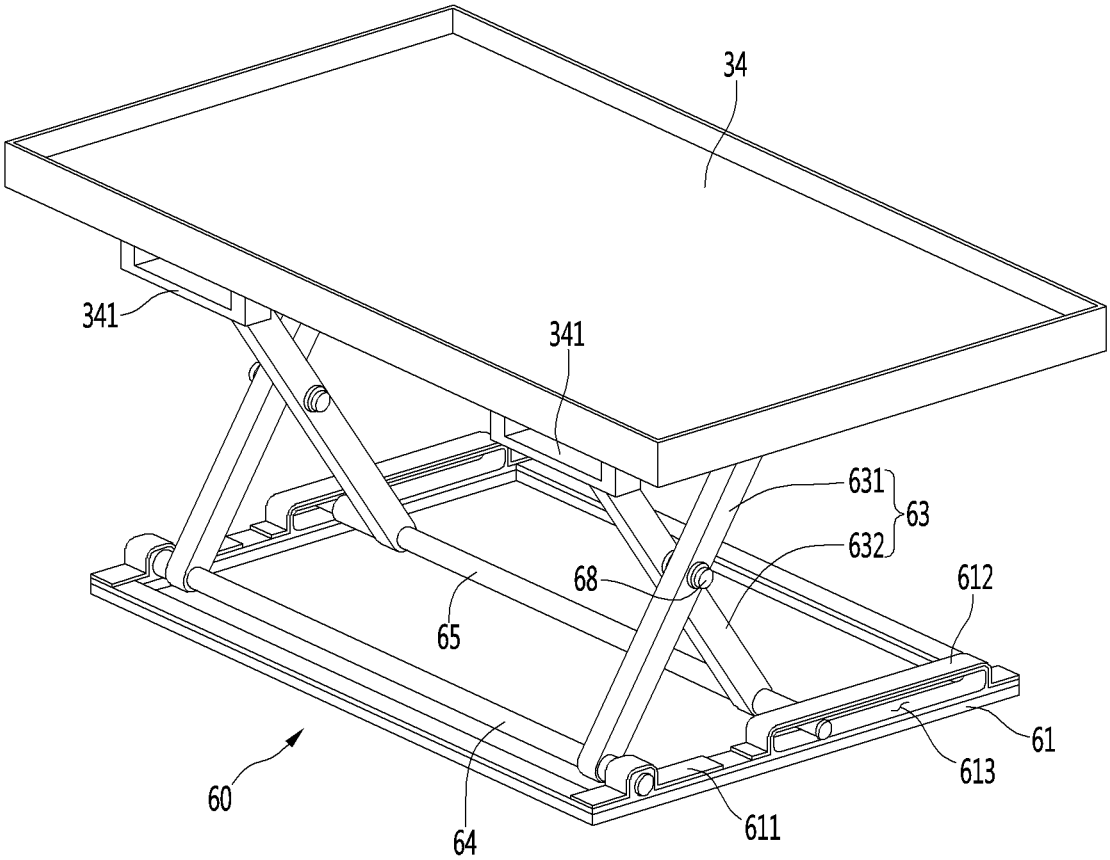
FIG. 16 is a perspective view of the elevation plate to which the plate support device is coupled.

FIG. 15 is a side view of the elevation plate to which a plate support device is coupled, and FIG. 16 is a perspective view of the elevation plate to which the plate support device is coupled.

Referring to FIGS. 15 and 16, a plate support device supporting the elevation plate 34 to maintain a horizontal state may be coupled to the bottom surface of the elevation plate 34.

For example, the plate support device 60 may include a lower frame 61, an upper frame 62, and a pair of scissor links 63.

In detail, each of the lower frame 61 and the upper frame 62 may be a rectangular frame having a size corresponding to a planar shape of the elevation plate 34.

The pair of scissor links 63 may be provided at left and right edges of the elevation plate 34, respectively.

Each of the pair of scissor links 63 may include a first link 631 and a second link 632 that cross each other in an X shape. Also, a connector 68 may be inserted into a crossing point of the first link 631 and the second link 632. Here, the connector 68 may serve as a rotation center of the first link 631 and the second link 632.

The left scissor link 63 may be defined as a left first link and a left second link, and the right scissor link 63 may be defined as a right first link and a right second link.

Front ends of the two first links and front ends of the two second links may be connected to each other by fixed bars 64 and 66, respectively. In detail, the front ends of the left and right first links may be connected to each other by the first fixed bar 64, and the front ends of the left and right second links may be connected to each other by the second fixed bar 66.

Rear ends of the two first links and the rear ends of the two second links may be connected to each other by movable bars 65 and 67, respectively. In detail, the rear ends of the left and right first links may be connected to each other by the first movable bar 67, and the rear ends of the left and right second links may be connected to each other by the second movable bar 65.

The first fixed bar 64 may be fixed to the lower frame 61, and the second fixed bar 66 may be fixed to the upper frame 62.

Also, the first movable bar 67 may be disposed to be movable forward and backward at the bottom surface of the upper frame 62, and the second movable bar 65 may be disposed to be movable forward and backward direction at the top surface of the lower frame 61.

In detail, the first fixed bar 64 may be fixed to the lower frame 61 by a lower holder 611, and the second fixed bar 66 may be fixed to the upper frame 62 by an upper holder 621. Each of the lower holder 611 and the upper holder 621 may be rounded or bent to cover the fixed bars 64 and 66, and both ends thereof may closely contact the lower frame 61 and the upper frame 62. Also, both ends of the lower holder 611 and the upper holder 621 may be fixed to the lower frame 61 and the upper frame 62 by coupling members, respectively.

The first movable bar 67 may be movably connected to a bottom surface of the upper frame 62 by an upper guide 622, and the second movable bar 65 may be movably connected to a top surface of the lower frame by a lower guide 612.

Each of the upper guide 622 and the lower guide 612 may include a bent part that is bent in an n shape and a contact part that is bent again from both ends of the bent part to the outside to respectively closely contact the upper frame 62 and the lower frame 61. An upper guide space 623 and a lower guide space 613 are disposed between a top surface of the bent part and a bottom surface of the upper frame 61 or a top surface of the lower frame 61, respectively. Ends of the first movable bar 67 and the second movable bar 65 may be inserted to move forward and backward, respectively.

While the elevation plate 34 ascends by the operation of the elevation device 50, the movable bars 65 and 67 slidably move in a direction that is closer to the fixed bars 64 and 66, that is, in the forward direction. Then, when the elevation plate 34 reaches the highest point, the movable bars 65 and 67 are disposed at the front ends of the guide spaces 613 and 623.

On the other hand, while the elevation plate 34 descends by the operation of the elevation device 50, the movable bars 65 and 67 slidably move in a direction that is away from the fixed bars 64 and 66, that is, in the backward direction. Then, when the elevation plate 34 reaches the lowest point, the movable bars 65 and 67 are disposed at the rear ends of the guide spaces 613 and 623.

As described above, since the scissor link 63 is connected to each of the left and right edges of the elevation plate 34, the elevation plate 34 may ascend or descend while maintaining the horizontal state even though a single elevation device 50 is connected to the elevation plate 34.

Also, since the plate support device 60 is disposed inside the storage box 32, the plate support device 60 is not exposed to the outside when the elevation plate 34 moves vertically. Thus, possibility of introduction of foreign substances into the plate support device 60 may be minimized, and also, possibility of user's injury due to catching of the user's clothing or body parts into the scissor link 63 may be prevented.

Alternatively, the plate support device 60 may be disposed at the rear end of the elevation plate, one end of the scissor link 63 may be disposed at the left edge of the elevation plate, and the other end may be disposed at the right edge of the elevation plate.

In this case, when the elevation plate 34 is elevated, a center of the scissor link 63 may only vertically move at the center of the rear end of the elevation plate, and both ends of the scissor link 63 may move in the left and right directions.

Figure 17:
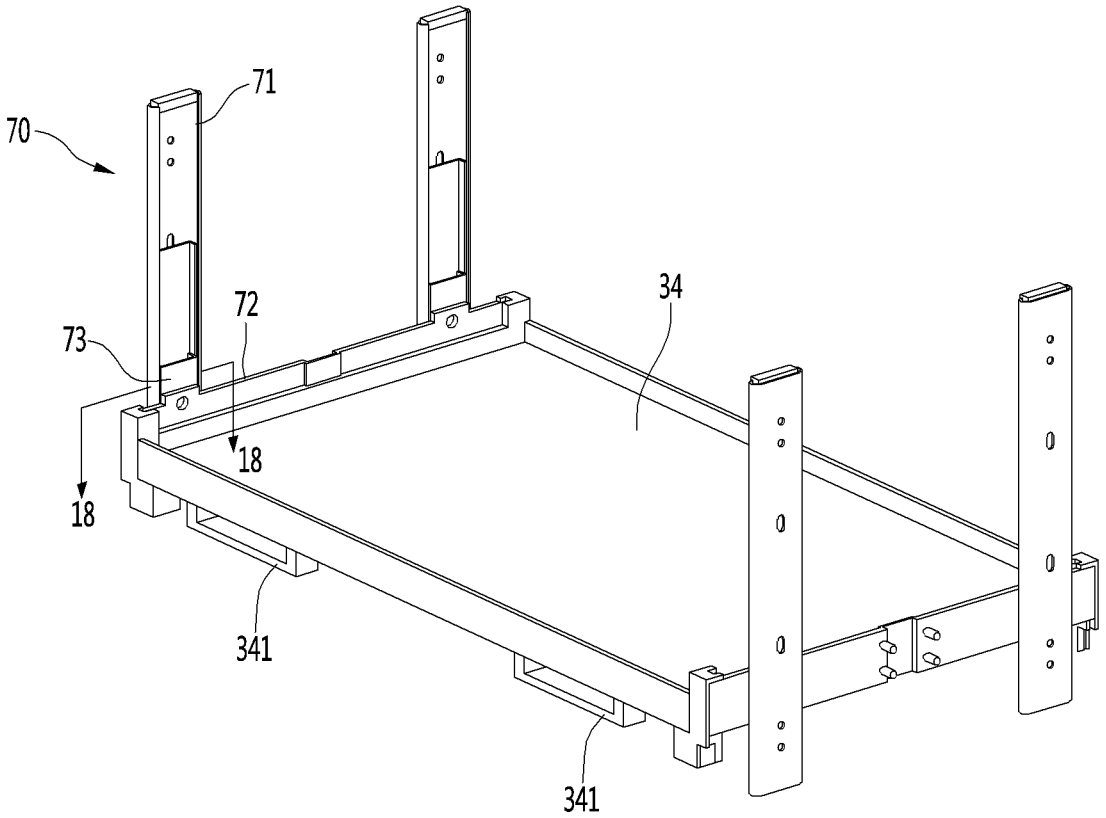
FIG. 17 is a perspective view of an elevation plate provided with a support device according to another embodiment.
Figure 18:
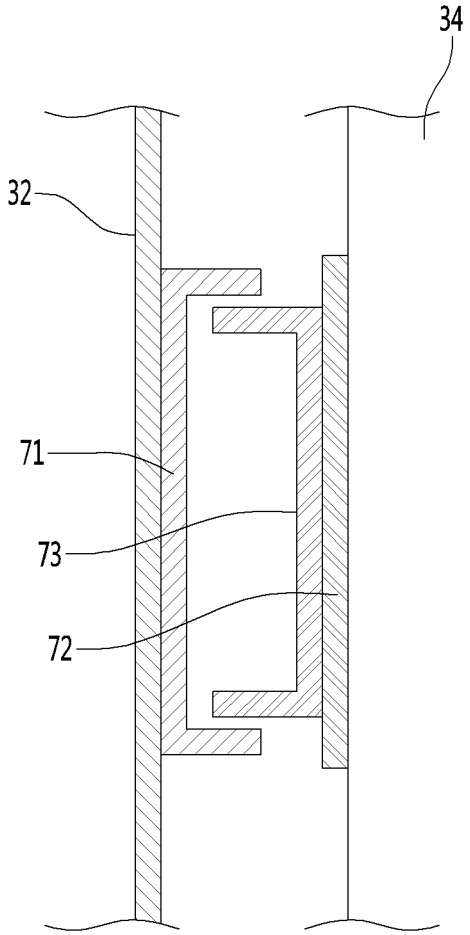
FIG. 18 is a transverse cross-sectional view taken along line 18-18 of FIG. 17.

FIG. 17 is a perspective view of an elevation plate provided with a support device according to another embodiment, and FIG. 18 is a transverse cross-sectional view taken along line 18-18 of FIG. 17.

Referring to FIGS. 17 and 18, in this embodiment, a plate support device 70 having a form of a rail and supporting left and right surfaces of an elevation plate 34 is proposed.

In detail, the plate support device 70 according to this embodiment may be mounted at front and rear ends of the left and right surfaces of the elevation plate 34, respectively. However, it is noted that the plate support device 70 may also have a structure in which the plate support device 70 is disposed at each of centers of the left and right surfaces of the elevation plate.

The plate support device 70 may include a fixed rail 71 fixed to an inner surface of a sidewall of a storage box 32, a rail base 72 fixed to a side surface of the elevation plate 34, and a movable rail 73 movably fixed to the rail base 72. Alternatively, the rail base 72 may not be separately provided, and the movable rail 73 may be directly fixed to the side surface of the elevation plate 34.

The movable rail 73 is disposed to be movable vertically along the fixed rail 72 in a state of being inserted into the fixed rail 72.

As described above, in the plate support device 70 having the rail shape, the elevation plate 34 may be symmetrically disposed at a position with respect to a vertical surface that bisects the elevation plate into left and right portions so that the elevation plate 34 stably moves vertically while being maintained in the horizontal state.

In addition to the above-described plate support device 70, it is noted that support devices having various shapes, which perform a support function in which the elevation plate 34 moves vertically while being maintained in the horizontal state are included in the spirit of the present disclosure.

Figure 19:
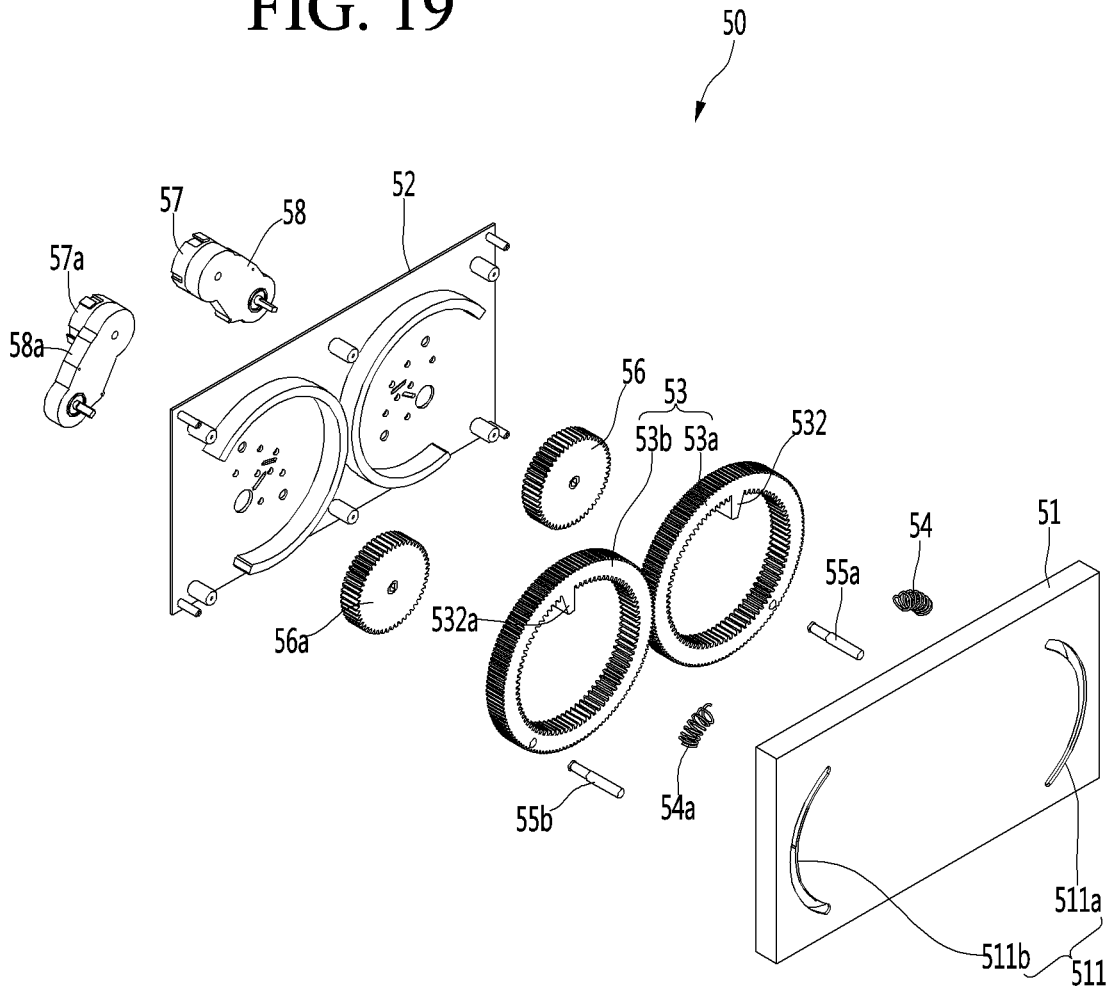
FIG. 19 is an exploded perspective view of an elevation device according to another embodiment.
Figure 20:
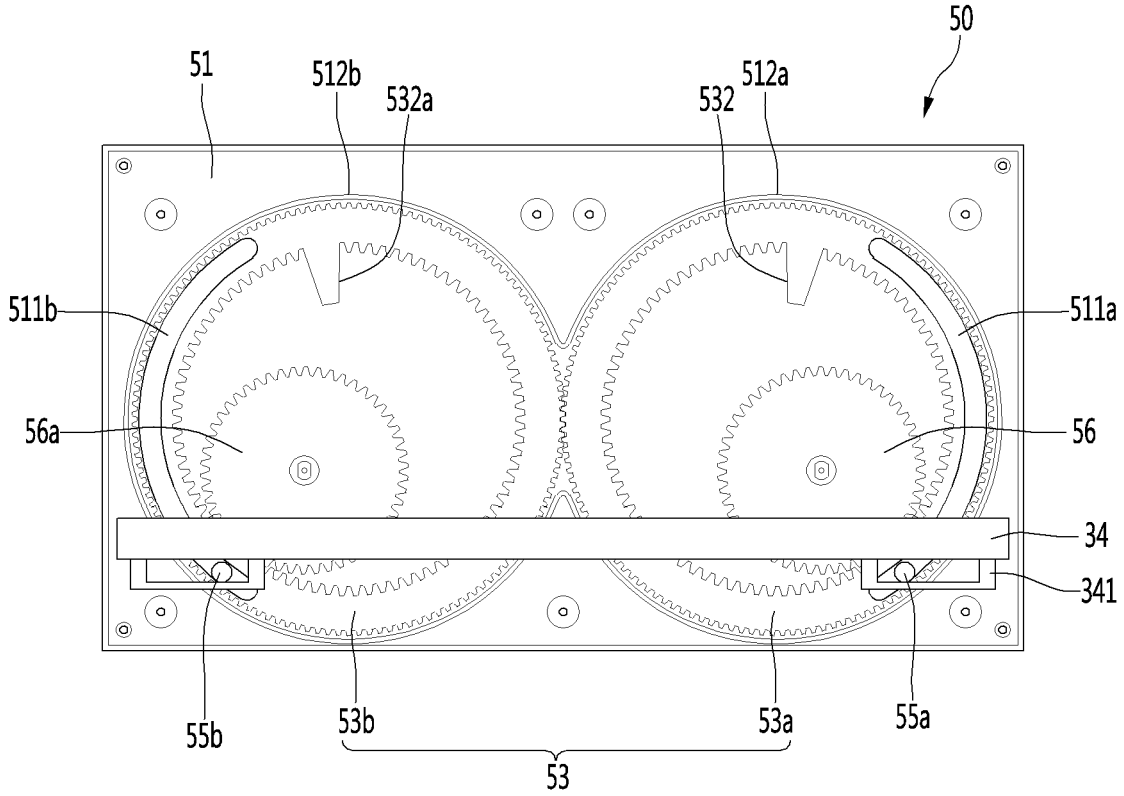
FIG. 20 is a rear view of a drawer when an elevation plate is connected to the elevation device.

FIG. 19 is an exploded perspective view of an elevation device according to another embodiment, and FIG. 20 is a rear view of a drawer when an elevation plate is connected to the elevation device.

Referring to FIGS. 19 and 20, an elevation device according to the embodiment has the same or similar structure as the elevation device described with reference to FIGS. 5 to 7 except that a spring 54*a*, and a driving gear 56*a*, a driving motor 57*a*, and a reduction gear 58*a*, which drive a second curved rack 53*b*, are additionally provided. The spring 54*a* operates in the same manner as the spring 54 described with reference to FIGS. 5 to 7.

That is, the elevation device 50 according to this embodiment has a feature in which the first curved rack 53*a* and the second curved rack 53*b* rotate by independently receiving power from different driving motors 57*a* and 57*b*. The driving gear 56*a* may be engaged with the gear part of the inner circumferential surface of the curved rack 53*b*. Otherwise, the driving gear 56*a* may be engaged with the gear part of the outer circumferential surface of the curved rack 53*b*.

Since outer circumferential surfaces of the first curved rack 53*a* and the second curved rack 53*b* are gear-coupled to each other, the first curved rack 53*a* and the second curved rack 53*b* may rotate at the same rate. Thus, the driving motors 57 and 57*a* may not only rotate at the same rotational rate but also be controlled to decelerate at the same rotational rate through the reduction gears 58 and 58*a*.

Since other constituents have been described in the foregoing embodiment, additional description thereof will be omitted.

Figure 21:
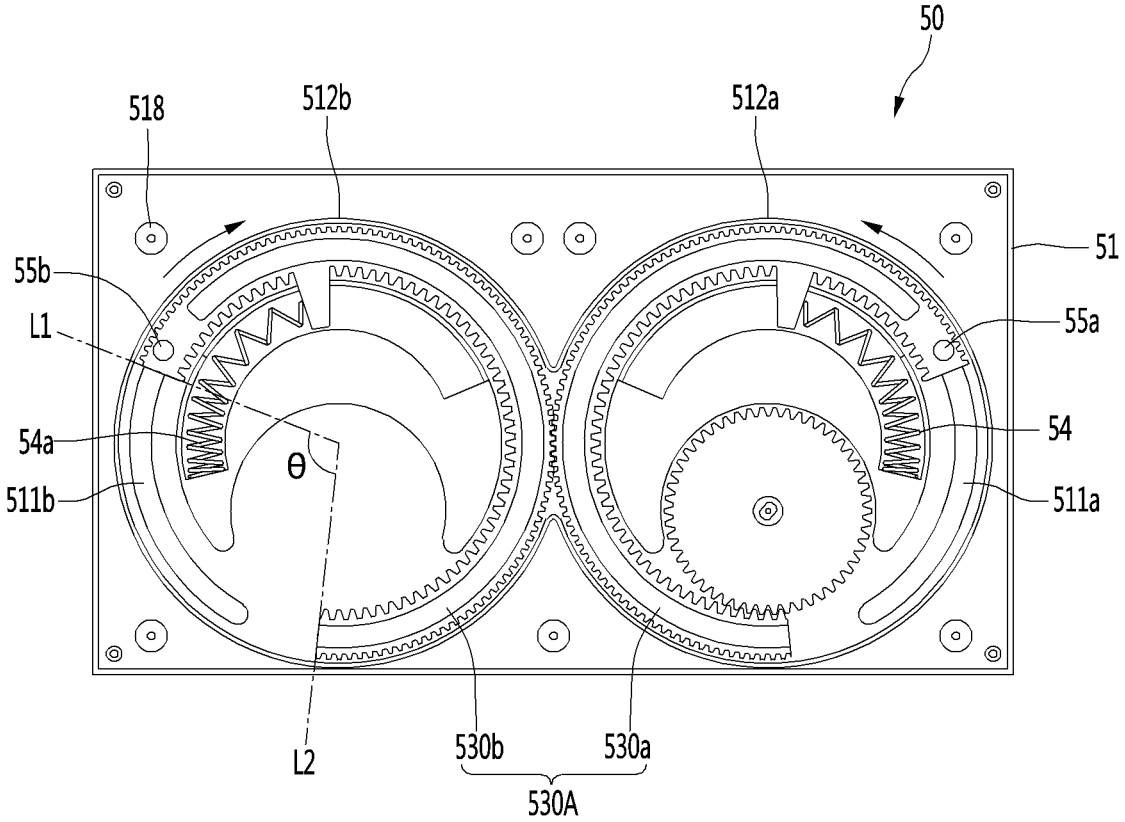
FIG. 21 is a rear view of an elevation device provided with a curved rack according to another embodiment.

FIG. 21 is a rear view of an elevation device provided with a curved rack according to another embodiment.

Referring to FIG. 21, a curved rack 530A according to this embodiment is characterized in that a pair of curved racks 530*a* and 530*b*, each of which has an arc shape, are gear-coupled to each other.

In detail, to ensure that the pair of curved racks 530*a* and 530*b* are always maintained in the gear-coupled state, each of the pair of curved racks 530*a* and 530*b* may have a length greater than that of a half of a circumference of the circular curved rack 53.

That is to say, an angle defined by a first straight line connecting one end to a center of each of the arc-shaped curved racks 530*a* and 530*b* and a second straight line connecting the other end to the center of each of the arc-shaped curved racks 530*a* and 530*b* may be an acute angle less than or about 90 degrees.

Figure 22:
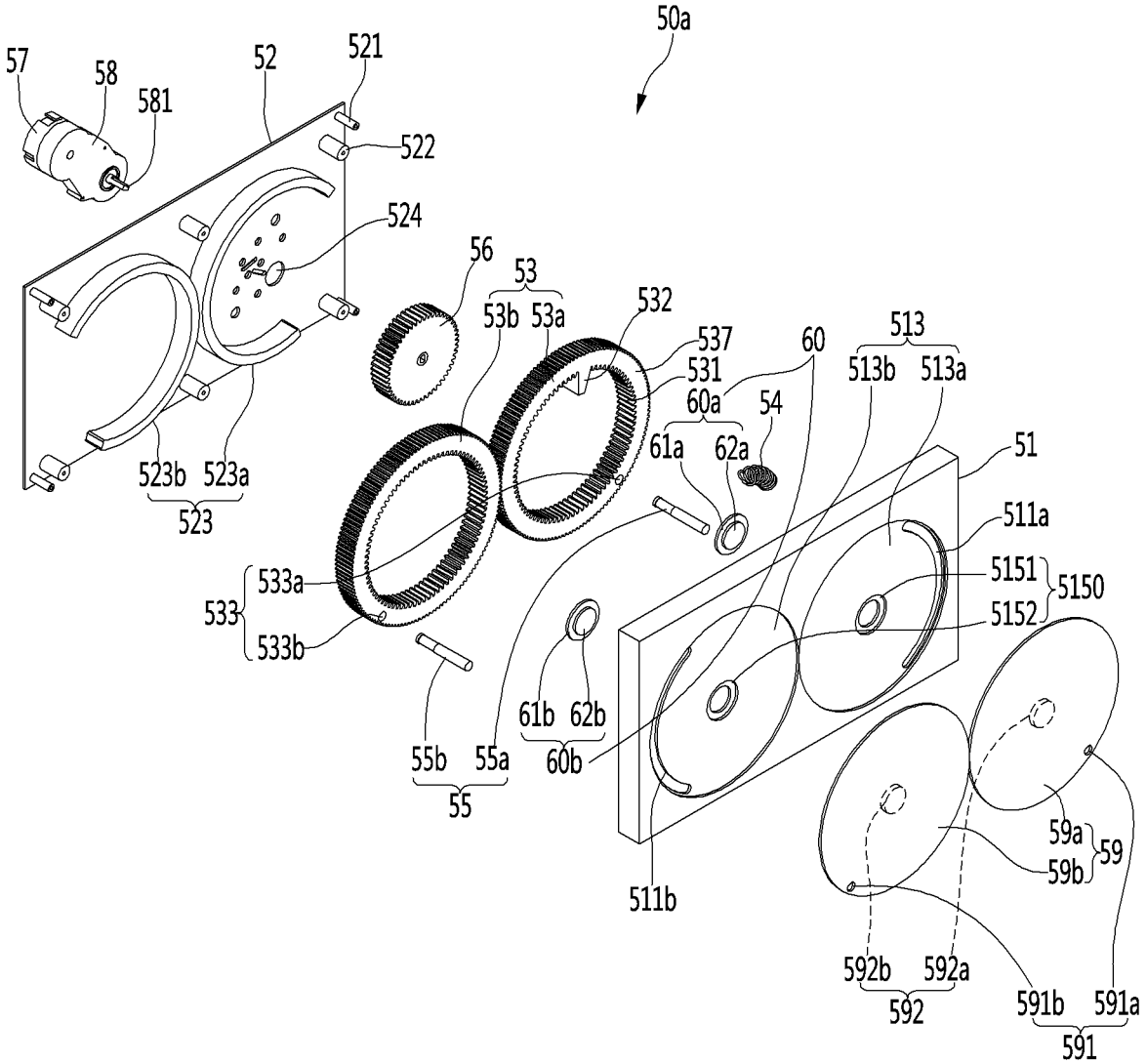
FIG. 22 is an exploded perspective view of an elevation device when viewed from a rear side according to another embodiment.

FIG. 22 is an exploded perspective view of an elevation device when viewed from a rear side according to another embodiment.

Referring to FIG. 22, an elevation device 50*a* according to this embodiment may have a feature in which a structure for preventing foreign substances from being introduced into an elevation device through a guide slit 311, through which an elevation bar 55 passes, is additionally provided on a rear surface of a sliding door 31 constituting a drawer 30.

When a user opens the drawer 30, if the guide slit 311 disposed in the rear surface of sliding door 31 is visible, not only is it aesthetically displeasing, but also foreign substances including food may get caught in the guide slit 311, and interfere with an operation of the elevation bar 55.

A separate storage case 33 may be provided on an elevation plate 34, and the above-described disadvantages may be solved. However, even if the separate storage case 33 is not provided, the above-described disadvantages may be solved by the elevation device 50*a* according to this embodiment.

In detail, the elevation device 50*a* according to this embodiment may have a feature in which a pair of rotation plates 59 and a pair of rotation plate holders 60 may be further added to the structure of the elevation device 50 according to the foregoing embodiment, and a pair of rotation plate mounting holes may be disposed in a rear surface of the sliding door 31. That is, the pair of rotation plates 59 corresponding to the pair of curved racks 53*a* and 53*b* are mounted on a rear surface of a housing 51, and the pair of rotation plates 59 cover the pair of rotation plate mounting holes disposed in the rear surface of the sliding door 31. According to this structure, an arc-shaped slit does not need to be disposed in the rear surface of the sliding door 31.

The pair of rotation plates 59 may include a first rotation plate 59*a* and a second rotation plate 59*b*, and the pair of rotation plate holders 60 may also include a first rotation plate holder 60*a* and a second rotation plate holder 60*b*.

Also, since the constituents of the driving motor 57, the reduction gear 58, the cover 52, the driving gear 56, the curved rack 53, the spring 54, and the elevation bar 55 are the same or similar as those according to the foregoing embodiment, duplicated description thereof will be omitted.

In more detail, the housing 51 of the elevation device 50*a* according to this embodiment has the following difference when compared to the housing 51 according to the foregoing embodiment.

First, the rotation plate seating part 513 on which the rotation plate 59 is seated may be disposed to be stepped or recessed at the rear surface of the housing 51. The stepped depth or recessed depth of the rotation plate seating part 513 may be less than the thickness of the rotation plate 59. That is, a portion of the thickness of the rotation plate 59 may be accommodated by the rotation plate seating part 513, and the other portion may be accommodated by the rear surface of the sliding door 31.

Also, the rotation plate seating part 513 may also include a first rotation plate seating part 513*a* and a second rotation plate seating part 513*b*.

The first guide slit 511*a* and the second guide slit 511*b* may be disposed inside the first rotation plate seating part 513*a* and the second rotation plate seating part 513*b*, respectively.

Second, a holder insertion hole 5150 into which the pair of rotation plate holders 60*a* and 60*b* are fitted may be disposed at the center of the rear surface of the housing 51. The holder insertion hole 5150 may also include a first holder insertion hole 5150 and a second holder insertion hole 5152.

Each of the pair of rotation plate holders 60*a* and 60*b* may include holder bodies 61*a* and 61*b*, each of which may have a diameter greater than that of the holder insertion hole 5150 and protrusions 62*a* and 62*b* extending from rear surfaces of the holder bodies 61*a* and 61*b*. Each of the protrusions 62*a* and 62*b* may have a cylindrical shape having a diameter equal to or less than that of the holder insertion hole 5150. Thus, when the rotation plate holders 60*a* and 60*b* are inserted into the holder insertion holes 515, only the protrusions 62*a* and 62*b* may pass through the holder insertion holes 515, and the holder bodies 61*a* and 61*b* may be disposed to contact the rear surface of the housing. Each of the protrusions 62*a* and 62*b* may have a length greater than a thickness of the rear surface of the housing 51.

The rotation plate 59 may include a circular plate part and a holder sleeve 592 extending from a center of a front surface of the circular plate part. An elevation bar insertion hole 591 may be disposed in an edge of the circular plate part.

Each of the holder sleeves 592*a* and 592*b* may have an inner diameter equal to or slightly less than that of each of the protrusions 62*a* and 62*b* to allow the protrusions 62*a* and 62*b* to be press-fitted into the holder sleeves 592*a* and 592*b*. However, the present disclosure is not limited thereto. For example, an edge of one side of each of the protrusions 62*a* and 62*b* may be cut off (D-cut) to define a non-circular cross-section, and each of the inside of the holder sleeves 592*a* and 592*b* may have the same shape as each of the protrusions 592*a* and 592*b*.

When the elevation device 50*a* is mounted at the rear surface of the sliding door 31, the circular plate part may be fitted into the rotation plate mounting hole, and the edge of the circular plate part and the edge of the rotation plate mounting hole may contact each other. In addition, since a gap does not occur between the circular plate part and the rotation plate mounting hole during the vertical movement of the elevation plate 34, food and other foreign substances may be prevented from being introduced into the sliding door 31. Thus, there may be an advantage in that a risk of a safety accident in which the user's fingers are caught is prevented.

Also, since the rear surface of the circular plate part and the rear surface of the housing 51 may define a smooth single surface, the phenomenon that the circular plate part interferes with the sliding door 31 when the elevation plate 34 is elevating may be prevented. In addition, there is an advantage to minimize the accumulation of dust on the edge portion of the circular plate part.

Although the constituents of the elevation device that elevates the elevation plate has been described in detail, the most basic and essential components that elevate the elevation plate may be the driving motor for generating power, the pair of curved racks that are connected to the driving motor to rotate by receiving the rotation force of the driving motor, and the elevation bar connecting the curved racks to the elevation plate. Here, the pair of curved racks may be engaged with each other to rotate.

Also, the various additional devices including the reduction gears, the driving gears, springs, and the like may be additional constituents, which are selectively provided as necessary to more stably perform the vertical movement of the elevation plate.

In addition, the number and mounting positions of the curved racks may also be appropriately designed as necessary to more stably perform the vertical movement of the elevation plate.

For example, two elevation devices having the above-described structure may be disposed at positions facing each other on the elevation plate, and thus, a structure in which a separate plate support device is not required may be realized. Alternatively, it may be possible to design a structure in which four elevation devices are respectively arranged at four edges of the elevation plate.

In addition, although not shown in the drawings, it is noted that the driving gear 56 is gear-coupled to an outer circumferential surface of one of the pair of curved racks 53 is also possible.

The refrigerator according to the proposed embodiments may have the following effects.

In detail, the refrigerator according to the embodiments may be configured so that the elevation plate provided in the drawer ascends in the state in which the drawer is withdrawn. Thus, there may be the advantage that the user does not need to excessively bow their waist so as to take out the food stored in the drawer.

Particularly, in the situation in which food is heavy or the container containing food to be lifted up is heavy, the elevation device may operate to allow the food to ascend up to a desired height, thereby preventing the user from being injured and improving the convenience of use.

Since the device that is necessary for elevating the elevation plate is disposed in the drawer, i.e., the storage box, the possibility of the user accessing to the device may be prevented. Thus, there may be the effect that accidents may be prevented, in which the user's clothing or body parts are caught.

Also, unlike the prior art, the storage box itself constituting the drawer is not elevated, and a separate elevation plate may be provided in the storage box. A rail assembly for withdrawing the drawer may be connected to the side surface of the storage box. Thus, there may be the advantage that the load acting on the rail assembly is designed to be distributed at the storage box.

Also, since the driving device is disposed inside the door or the storage box, there may be the advantage of minimizing the noise.

Also, the driving device that occupies a large portion of the all constituents of the elevation device may be disposed in the door part to minimize the storage capacity loss of the storage box.

Also, since the pair of curved racks are gear-coupled, the pair of elevation bars coupled to the curved rack may be elevated at the same rate and same height. Also, the pair of elevation bars connected to the pair of curved racks may support the left and right edges of the elevation plate. Thus, there may be the advantage in that the elevation plate is not shaken and ascends or descends while being maintained in the horizontal state.

Also, since the pair of curved racks are gear-coupled, the structure in which one driving motor is connected to only one of the pair of curved racks may be provided to reduce the weight of the elevation device. In the case of applying one driving motor, the motor power may be set to be greater than that in the case of applying two driving motors.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage space therein; and a drawer slidably movable forward and backward from the storage space, the drawer comprising:

a door;

a storage box provided at a rear surface of the door;

an elevation plate disposed within the storage box; and an elevation device connected with one side of the elevation plate to vertically elevate the elevation plate, wherein the elevation device comprises:

a driving motor;

a first curved rack to rotate by a rotational force generated by the driving motor, the first curved rack being curved at a predetermined curvature and having an outer circumferential surface;

a first elevation bar to connect the first curved rack with the elevation plate;

a second curved rack provided independently from the first curved rack, being curved at a predetermined curvature and having an outer circumferential surface to engage with the outer circumferential surface of the first curved rack; and a second elevation bar to connect the second curved rack with the elevation plate.

2. The refrigerator according to claim 1, wherein each of the first and second curved racks comprises a circular rack or an arc rack.

3. The refrigerator according to claim 1, further comprising a driving gear connected with the driving motor and gear-connected with the first curved rack to rotate the first curved rack, wherein the driving gear is gear-connected with the outer circumferential surface or an inner circumferential surface of the first curved rack.

4. The refrigerator according to claim 3, further comprising a reduction gear connected with a shaft of the driving motor to reduce a rotational rate of the driving motor, wherein the driving gear is connected with a driving shaft of the reduction gear.

5. The refrigerator according to claim 2, wherein the elevation device is accommodated at the door, and the first elevation bar and the second elevation bar pass through a rear surface of the door to connect with the one side of the elevation plate.

6. The refrigerator according to claim 5, wherein the first elevation bar and the second elevation bar move vertically in an arc to ascend or descend the elevation plate, and supporting a left bottom surface and a right bottom surface of the elevation plate, respectively, wherein as the first elevation bar and the second elevation bar move to ascend or descend the elevation plate, the first elevation bar and the second elevation bar traverse horizontally in directions that are away from each other or closer to each other with respect to the elevation plate.

7. The refrigerator according to claim 6, wherein each end of the first elevation and the second elevation bars includes an idle gear that is in connection with the elevation plate, respectively.

8. The refrigerator according to claim 7, wherein the elevation plate includes a first gear part at the left bottom surface and a second gear part at the right bottom surface, and the idle gear of the respective first elevation bar and the second elevation bar engages with the respective first gear part and the second gear part.

9. The refrigerator according to claim 8, wherein the elevation plate comprises a first guide groove at the left bottom surface and a second guide groove at the right bottom surface to guide the idle gear of the respective first elevation bar and the second elevation bar, the first gear part is disposed at the first guide groove and the second gear part is disposed at the second guide groove.

10. The refrigerator according to claim 1, further comprising a plate support device to support the elevation plate to maintain a horizontal state while the elevation plate ascends and descends.

11. The refrigerator according to claim 10, wherein the plate support device comprises a pair of scissor links to connect the elevation plate with a bottom of the storage box, and one scissor link is disposed to connect one side of the elevation plate with the bottom of the storage box, and another scissor link is disposed to connect another side of the elevation plate with the bottom of the storage box.

12. The refrigerator according to claim 10, wherein the plate support device comprises a rail assembly to connect the elevation plate with the storage box, wherein the rail assembly comprises:

a fixed rail connected with the storage box; and a movable rail connected with the elevation plate and movably connected with the fixed rail.

13. The refrigerator according to claim 12, wherein the rail assembly is provided in one or in plurality at one surface and another surface at the storage box.

14. The refrigerator according to claim 1, further comprising a spring disposed at an inner circumference of the first rack, the spring being compressed when the elevation plate descends.

15. The refrigerator according to claim 1, wherein the rear surface of the door comprises a first arc-shaped guide slit and a second arc-shaped guide slit through which the first bar and the second bar protrude, respectively.

16. The refrigerator according to claim 1, further comprising:

a first rotation plate having an elevation bar insertion hole, through which the first elevation bar is inserted;

a second rotation plate having an elevation bar insertion hole, through which the second elevation bar is inserted; and a pair of rotation plate mounting holes disposed at the rear surface of the door into which the first rotation plate and the second rotation plate are respectively mounted.

17. The refrigerator according to claim 1, further comprising:

another driving motor to provide a rotational force to the second curved rack;

a first driving gear gear-connected with the first curved rack to rotate the first curved rack; and a second driving gear gear-connected with the second curved rack to rotate the second curved rack, wherein the first driving gear is gear-connected with the outer circumferential surface or an inner circumferential surface of the first curved rack, and the second driving gear is gear-connected with the outer circumferential surface or an inner circumferential surface of the second curved rack.

18. The refrigerator according to claim 17, further comprising:

a first reduction gear connected with a rotation shaft of the driving motor to reduce a rotational rate of the driving motor; and a second reduction gear connected with a rotation shaft of the another driving motor to reduce a rotational rate of the another driving motor, wherein the first driving gear is connected with a driving shaft of the first reduction gear, and the second driving gear is connected with a driving shaft of the second reduction gear.

19. The refrigerator according to claim 17 further comprising:

a first spring disposed at the inner circumference of the first rack; and a second spring disposed at the inner circumference of the second rack, wherein the first spring and the second spring being compressed when the elevation plate descends.

20. The refrigerator according to claim 1, further comprising a manipulation part provided at the drawer to input at least one of a draw-in/out command of the drawer and an operation command of the elevation device.

* * * * *